US007994701B2

(12) United States Patent
Teramoto et al.

(10) Patent No.: US 7,994,701 B2
(45) Date of Patent: Aug. 9, 2011

(54) ELECTRON-EMITTING DEVICE, ELECTRON SOURCE, IMAGE DISPLAY APPARATUS, AND MANUFACTURING METHOD OF ELECTRON-EMITTING DEVICE

(75) Inventors: Yoji Teramoto, Ebina (JP); Ryoji Fujiwara, Chigasaki (JP); Michiyo Nishimura, Sagamihara (JP); Kazushi Nomura, Sagamihara (JP); Shunsuke Murakami, Atsugi (JP)

(73) Assignee: Canon Kabushiki Kaisha, Tokyo (JP)

( * ) Notice: Subject to any disclaimer, the term of this patent is extended or adjusted under 35 U.S.C. 154(b) by 269 days.

(21) Appl. No.: 12/327,858

(22) Filed: Dec. 4, 2008

(65) Prior Publication Data

US 2009/0140627 A1 Jun. 4, 2009

(30) Foreign Application Priority Data

Dec. 4, 2007 (JP) ..... 2007-313702

(51) Int. Cl.
*H01J 1/62* (2006.01)

(52) U.S. Cl. ..... 313/497; 313/495

(58) Field of Classification Search ..... 313/495–497, 313/309–311

See application file for complete search history.

(56) References Cited

U.S. PATENT DOCUMENTS

| | | | | |
|---|---|---|---|---|
| 5,798,604 | A | 8/1998 | Duboc, Jr. et al. | |
| 6,267,636 | B1 | 7/2001 | Onishi et al. | 445/6 |
| 6,379,211 | B2 | 4/2002 | Onishi et al. | 445/73 |
| 6,717,340 | B2 | 4/2004 | Nishimura | 313/310 |
| 6,853,126 | B2 | 2/2005 | Nomura | 313/492 |
| 6,975,288 | B2 | 12/2005 | Nishimura et al. | 345/74.1 |
| 7,021,981 | B2 | 4/2006 | Onishi et al. | 445/6 |
| 7,074,102 | B2 | 7/2006 | Teramoto | 445/24 |
| 7,109,663 | B2 | 9/2006 | Fujiwara et al. | 315/169.4 |
| 7,259,520 | B2 | 8/2007 | Fujiwara et al. | 315/169.1 |
| 7,391,150 | B2 | 6/2008 | Nomura | 313/497 |
| 7,405,092 | B2 | 7/2008 | Nishimura | 438/20 |
| 7,435,689 | B2 | 10/2008 | Teramoto | 438/750 |
| 7,456,565 | B2 | 11/2008 | Nomura et al. | 313/497 |
| 2002/0036452 | A1* | 3/2002 | Muroyama et al. | 313/310 |
| 2003/0001477 | A1* | 1/2003 | Sasaguri | 313/310 |
| 2003/0067259 | A1* | 4/2003 | Nishimura | 313/310 |
| 2005/0202745 | A1 | 9/2005 | Nishimura | 445/5 |
| 2006/0066199 | A1 | 3/2006 | Ichikawa et al. | 313/311 |
| 2006/0125370 | A1 | 6/2006 | Nishimura et al. | 313/310 |
| 2007/0188068 | A1 | 8/2007 | Murakami | 313/310 |
| 2007/0257593 | A1 | 11/2007 | Murakami | 313/311 |
| 2008/0012463 | A1 | 1/2008 | Fujiwara et al. | 313/310 |
| 2008/0070468 | A1 | 3/2008 | Ichikawa et al. | 445/51 |
| 2009/0026914 | A1 | 1/2009 | Nomura et al. | 313/498 |

* cited by examiner

*Primary Examiner* — Bumsuk Won

(74) *Attorney, Agent, or Firm* — Fitzpatrick, Cella, Harper & Scinto

(57) ABSTRACT

An electron-emitting device according to this invention has a cathode electrode, a first electrode, a second electrode, an insulating layer, a gate electrode, and an electron-emitting member. The gate electrode, the insulating layer, and the first electrode respectively have an opening communicating with each other. The electron-emitting member is provided on the cathode electrode, and at least a portion of the electron-emitting member is exposed in the opening. The second electrode is provided in the opening of the first electrode and electrically connected to the cathode electrode.

12 Claims, 14 Drawing Sheets

ELECTRON-EMITTING DEVICE, ELECTRON SOURCE, IMAGE DISPLAY APPARATUS, AND MANUFACTURING METHOD OF ELECTRON-EMITTING DEVICE

BACKGROUND OF THE INVENTION

1. Field of the Invention

This invention relates to an electron-emitting device, an electron source, an image display apparatus, and a manufacturing method of an electron-emitting device.

2. Description of the Related Art

In order to apply an electron-emitting device to an image display apparatus, an enough emission current to make a phosphor luminous with sufficient luminance is required. Additionally, an electron beam applied to the phosphor is required to have a small diameter in order to realize a high definition display. Further, the ease of production of the electron-emitting device is important.

In order to make the phosphor luminous with sufficient luminance, an emission current density may be increased.

As a field emission (FE) type electron-emitting device, there is a Spindt-type electron-emitting device, for example. In general, the Spindt-type electron-emitting device has a microchip as an electron-emitting member and emits electrons from the top end. The Spindt-type electron-emitting device generally has plural microchips per one device in order to increase the emission current density. In some cases, a structure for focusing an electron beam between a gate electrode and a cathode electrode may be formed. Such a structure is disclosed in, for example, U.S. Pat. No. 5,798,604.

Meanwhile, as the field emission (FE) type electron-emitting device, there is an electron-emitting device in which at least one portion of a thin film provided on a cathode electrode is exposed in an opening of a gate electrode and an insulating layer to perform electron emission from the exposed portion.

A material with a low work function is used as the electron emission material used in the thin film, whereby an electron-emitting device which can emit electrons without using a microchip can be formed. Further, the electron-emitting devices emit electrons from the surface of the thin film, and therefore, concentration of an electric field is more difficult to occur than the electron-emitting device using the microchip and has a long life.

However, the emission current density of the above thin film is small, and therefore, in order to obtain more emission current, the exposed area of the thin film is required to be increased, or the electric field is required to be effectively applied on the surface of the thin film.

In general, as with the Spindt-type electron-emitting device, plural openings (each opening of the gate electrode and the insulating layer) are provided in one electron-emitting device, and the opening of the insulating layer is formed to be larger than the opening of the gate electrode. However, the formation of plural openings (each opening of the gate electrode and the insulating layer) results in the increasing of the size of the electron-emitting device.

SUMMARY OF THE INVENTION

The present invention has been made in order to solve the above prior art problems and it is therefore an object of the present invention to provide an electron-emitting device, which can realize a large emission current without increasing the size of the electron-emitting device, and, at the same time, can be easily produced. A further object of the present invention is to provide an electron source using this electron-emitting device and a high quality and high definition image display apparatus using this electron source.

In order to achieve the above objects, a first embodiment of an electron-emitting device according to this invention has a cathode electrode, a first electrode, an insulating layer, a gate electrode, and an electron-emitting member. The gate electrode is located above the cathode electrode. The insulating layer is located between the gate electrode and the cathode electrode. The first electrode is located between the cathode electrode and the insulating layer and electrically connected to the cathode electrode. The gate electrode, the insulating layer, and the first electrode respectively have an opening communicating with each other. The electron-emitting member is provided on the cathode electrode, and, at the same time, at least a portion thereof is exposed in the opening. The electron-emitting device is characterized by having in the opening of the first electrode a second electrode electrically connected to the cathode electrode.

A second embodiment of an electron-emitting device according to this invention has a cathode electrode, a first electrode, an insulating layer, a gate electrode, and an electron-emitting member. The electron-emitting member, the first electrode, the insulating layer, and the gate electrode are formed in this order on the cathode electrode. The gate electrode, the insulating layer, and the first electrode have an opening through which the electron-emitting member is exposed. The electron-emitting device is characterized by having a second electrode formed on the electron-emitting member in the opening.

A third embodiment of an electron-emitting device according to this invention has a cathode electrode, a first electrode, an insulating layer, a gate electrode, and an electron-emitting member. The electron-emitting member, the first electrode, the insulating layer, and the gate electrode are formed in this order on the cathode electrode. The gate electrode and the insulating layer have a first opening, and the first electrode has a plurality of second openings for exposing the electron-emitting member in the first opening.

A manufacturing method of an electron-emitting device according to this invention has a step of forming a cathode electrode, a first electrode, an insulating layer, a gate electrode, and an electron-emitting member. The gate electrode is located above the cathode electrode. The insulating layer is located between the gate electrode and the cathode electrode. The first electrode is located between the cathode electrode and the insulating layer and electrically connected to the cathode electrode. The gate electrode, the insulating layer, and the first electrode respectively have an opening communicating with each other. The electron-emitting member is provided on the cathode electrode, and, at the same time, at least a portion thereof is exposed in the opening. This method is characterized by having a step of providing in the opening of the first electrode a second electrode electrically connected to the cathode electrode.

An electron source according to this invention is characterized by having a plurality of the electron-emitting devices.

An image display apparatus according to this invention is characterized by having the electron source and an image forming member which forms an image by electrons emitted from the electron source.

According to this invention, a large emission current can be obtained without increasing the size of the electron-emitting device, and, at the same time, the electron-emitting device which can be easily produced can be provided. An electron source using this electron-emitting device and a high quality and high definition image display apparatus using this electron source can be provided.

Further features of the present invention will become apparent from the following description of exemplary embodiments with reference to the attached drawings.

DESCRIPTION OF THE EMBODIMENTS

Hereinafter, the preferred embodiments of this invention are exemplarily described in detail with reference to the drawings. However, it is not intended to limit the scope of this invention only to the size, material, shape, and relative arrangement of components described in this embodiment, unless particularly specified. In addition, the condition of the voltage applied to a cathode electrode, a gate electrode, and an anode electrode, the condition of a drive waveform, and other conditions are not intended to be limited unless particularly specified.

An electron-emitting device according to the embodiment of this invention is described with reference to the drawings.

Figure 1A:
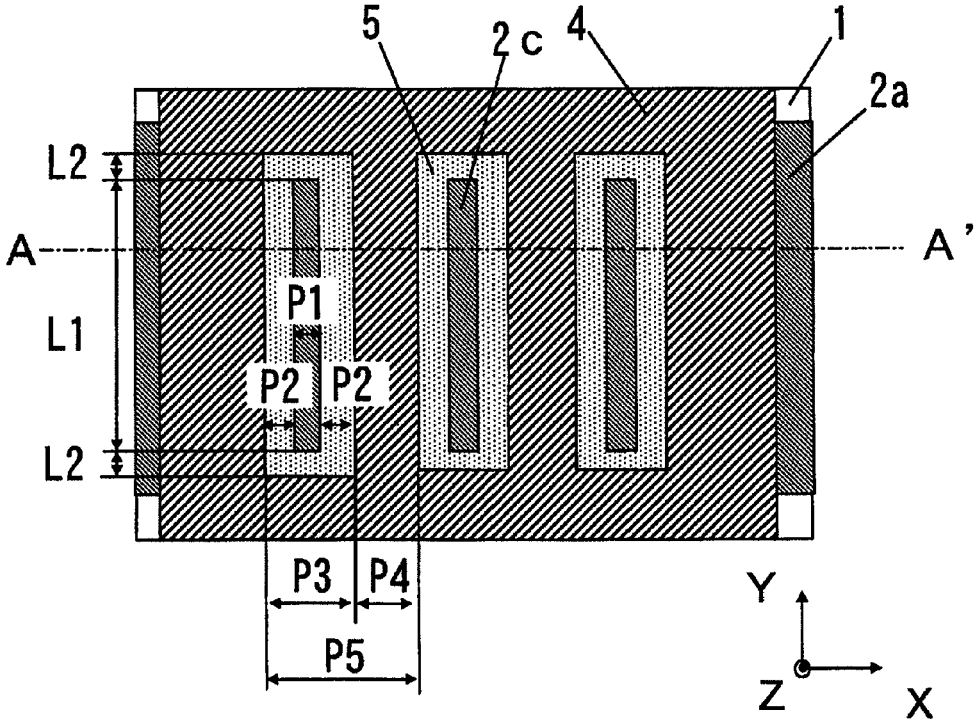
FIG. 1A is a top plan view of an electron-emitting device according to the present embodiment.
Figure 1B:
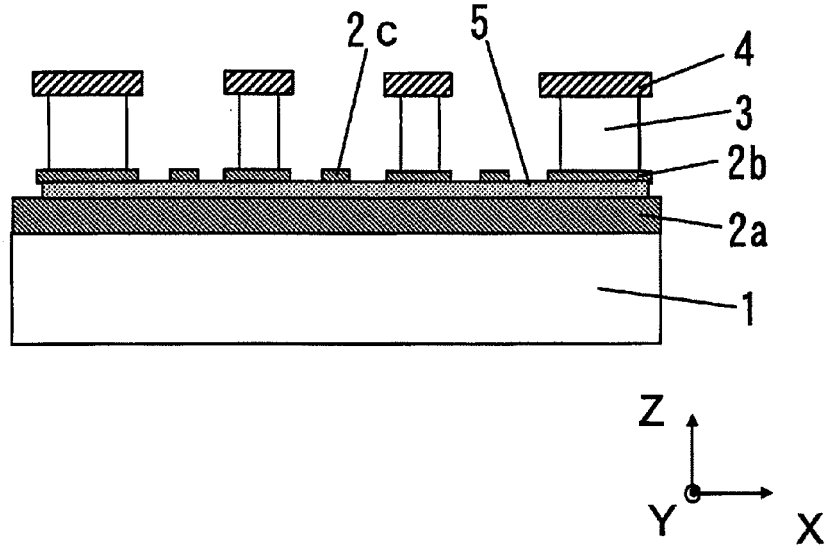
FIG. 1B is an A-A' cross-sectional view of FIG. 1A.

FIGS. 1A and 1B are schematic views of the electron-emitting device according to the present embodiment. FIG. 1A is a top plan view of the electron-emitting device (as viewed from the direction that electrons are emitted). FIG. 1B is an A-A' cross-sectional view of FIG. 1A.

In FIGS. 1A and 1B, reference numerals 1, 2*a*, 2*b*, 3, 4, and 5 are respectively a substrate, a cathode electrode, a first electrode, an insulating layer, a gate electrode, and an electron-emitting member.

As shown in FIGS. 1A and 1B, in the electron-emitting device according to this embodiment, the gate electrode 4 is located above the cathode electrode 2*a* (the direction that electrons are emitted). The insulating layer 3 is located between the gate electrode 4 and the cathode electrode 2*a*. The first electrode 2*b* is located between the cathode electrode 2*a* and the insulating layer 3. The electron-emitting member 5 is provided on the cathode electrode 2*a*. The gate electrode 4, the insulating layer 3, and the first electrode 2*b* respectively have an opening, and these openings communicate with each other. All or portion of the electron-emitting member 5 is exposed in the opening (the region in which the electron-emitting member 5 is exposed is hereinafter referred to as an exposed region). Incidentally, the cathode electrode 2*a* and the first electrode 2*b* are electrically connected to each other. The first electrode 2*b* has the same electrical potential as the cathode electrode 2*a*, whereby the focusing rate of electron beams emitted from the electron-emitting device is improved (a focusing potential structure is formed).

Further, in the electron-emitting device according to this embodiment, a second electrode 2*c* is provided in the opening of the first electrode 2*b*. The second electrode 2*c* is electrically connected to the cathode electrode 2*a* (that is, electrically connected also to the first electrode 2*b*) and provided so that the length of the contour of the exposed region of the electron-emitting member 5 is increased. According to this constitution, it is possible to obtain a large emission current without increasing the size of the electron-emitting device (the detail is described later).

FIGS. 1A and 1B show the electron-emitting device having the cathode electrode, the first electrode, the insulating layer, the gate electrode, and the electron-emitting member. The electron-emitting member, the first electrode, the insulating layer, and the gate electrode are formed in this order on the cathode electrode. The gate electrode, the insulating layer, and the first electrode respectively have an opening through which the electron-emitting member is exposed. The electron emission display in FIGS. 1A and 1B further has a second electrode formed on the electron-emitting member in the opening.

Figure 2:
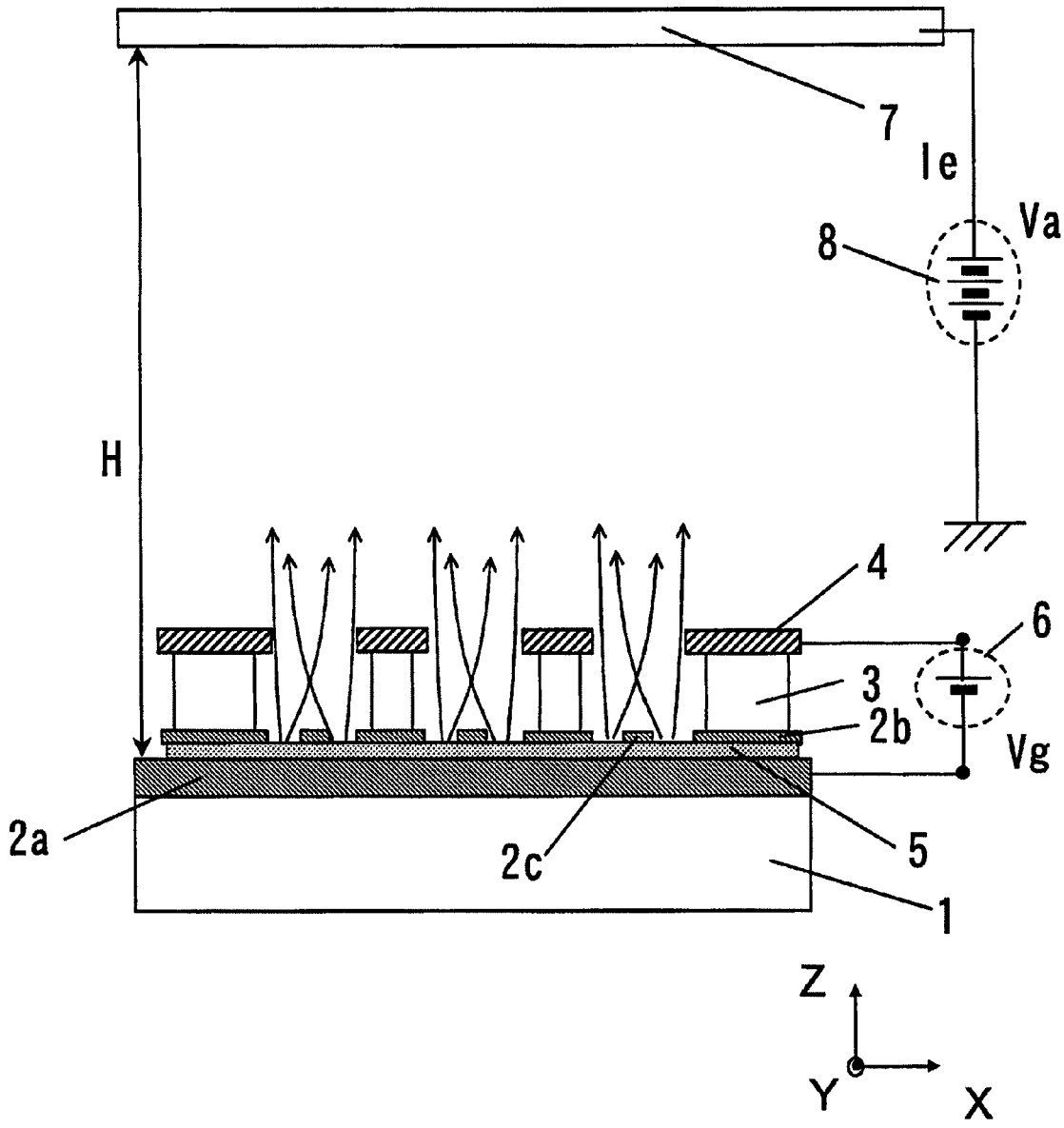
FIG. 2 is a view showing an example of a method for driving the electron-emitting device according to the present embodiment.

FIG. 2 is a view showing an example of a method for driving the electron-emitting device according to this embodiment. The components same as those in FIGS. 1A and 1B are represented by same numbers.

A driving voltage Vg is applied between the cathode electrode 2*a* and the gate electrode 4 by a power supply 6.

A reference numeral 7 is an anode electrode disposed above the electron-emitting device at a distance of H. An anode voltage Va is applied to the anode electrode 7 by a high-voltage power supply 8. The emitted electrons are trapped by the anode electrode 7, and an electron emission current Ie is detected.

The electron-emitting device according to this embodiment has two kinds of openings. One is a first opening formed of the insulating layer 3 or the gate electrode 4. Another one is a second opening formed of the first electrode 2*b* and second electrodes 2*c*. In this embodiment, the shape of the opening of the first electrode 2*b* is substantially the same as the shape of the opening of the gate electrode 4.

FIGS. 3A to 3F show a distribution of an electric field intensity near the surface of the electron-emitting member in the driving state of the electron-emitting device.

Figure 3A:
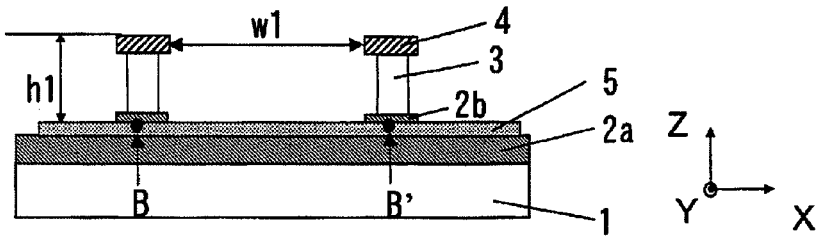
FIG. 3A is a cross-sectional view of an electron-emitting device having one kind of opening.
Figure 3B:
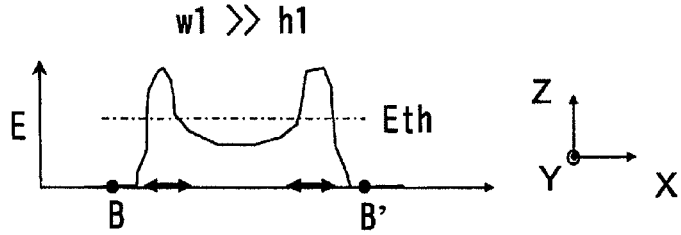
FIG. 3B is a graph showing a distribution of an electric field intensity applied to the vicinity of the surface of the electron-emitting member shown in FIG. 3A.
Figure 3C:
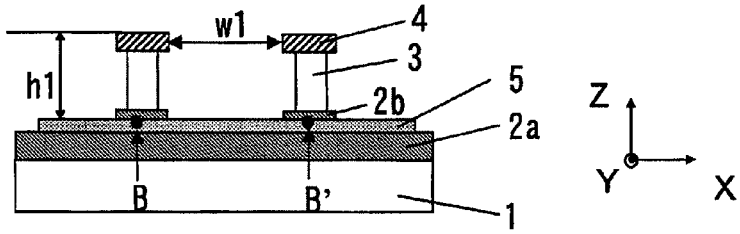
FIG. 3C is a cross-sectional view of the electron-emitting device having one kind of opening.
Figure 3D:
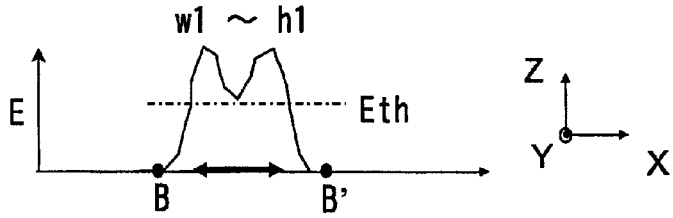
FIG. 3D is a graph showing a distribution of the electric field intensity applied to the vicinity of the surface of the electron-emitting member shown in FIG. 3C.

FIGS. 3A and 3C are cross-sectional views of an electron-emitting device with one kind of opening. FIGS. 3B and 3D are graphs showing a distribution of the electric field intensity in the vicinity of the surface of each electron-emitting member shown in FIGS. 3A and 3C.

The first electrode 2*b* is disposed closer to the gate electrode 4 than the electron-emitting member 5 (first electrode 2*b* is disposed above the electron-emitting member 5), whereby the distribution of the electric field intensity near the surface of the electron-emitting member 5 is varied. Specifically, the electric field intensity near the surface of the electron-emitting member 5 is the highest of all regions corresponding to the periphery of the contour of the opening of the gate electrode 4, as shown in FIGS. 3B and 3D. In other words, the second cathode electrode 2*b* hollows an equipotential surface above the electron emission surface of the electron-emitting member. The electron beam is directed toward inside the opening by virtue of such a distribution of the electric field intensity. Namely, the focusing effect of the electron beam can be obtained. In addition, the collision of the electron with the insulating layer 3 and the gate electrode 4 can be avoided. Therefore, the first electrode 2*b* can be called a focusing electrode.

However, when the gate electrode has a large opening (opening width w1 of the gate electrode>> distance h1 between the surface of the electron-emitting member and the surface of the gate electrode), the electric field intensity of a region (of the electron-emitting member surface) corresponding to the periphery of the contour of the opening of the gate electrode becomes large, but the electric field intensity at the central part of the opening becomes small. In this case, when the minimum electric field intensity (threshold electric field intensity) required for emitting electrons is supposed as Eth, the region from which the electrons are emitted has the electric field intensity more than Eth, and the electrons are emitted from two regions corresponding to the periphery of the contour of the opening of the gate electrode in the example of FIG. 3B. When the opening of the gate electrode is supposed to have a rectangular shape, the electrons are emitted from the region corresponding to the periphery of the contour of the rectangular shape. Hereinafter, the region from which electrons are emitted is called an emission region. In this embodiment, the size of the opening is assumed to be the width of the opening in the cross section of the electron-emitting device.

When the opening of the gate electrode is reduced in size, the distance between the two regions shown in FIG. 3B becomes small, the two emission regions become one as shown in FIG. 3D, and the electrons are emitted from the almost entire region inside the opening.

Namely, when the opening of the gate electrode is small in size, the electric field with the electric field intensity not less than the threshold electric field intensity is applied onto the surface of the electron-emitting member corresponding to the inside of the opening of the gate electrode. Meanwhile, when the opening of the gate electrode is large in size, the electric field with the electric field intensity not less than the threshold electric field intensity is applied to only the region corresponding to the periphery of the contour of the gate electrode.

Indeed, the emission region is determined not by the absolute value of the size of the opening of the gate electrode, but by the ratio of the opening width w1 of the gate electrode to the distance h1 between the electron-emitting member surface and the gate electrode surface. If w1:h1=1:1, the emission region becomes in a planar shape. If w1:h1=2:1, the emission region starts to be separated into two regions. If w1:h1 is 3:1 or above, the emission region becomes in a linear shape.

Thus, when the ratio cannot approach 1:1, the electron emission density (emission current) of the electron-emitting device is reduced. For example, when small electron-emitting devices are produced, the ratio of the size of the opening of the gate electrode (opening diameter) to the distance between the electron-emitting member surface and the gate electrode surface cannot approach 1:1. In order to obtain a high emission current in a small electron-emitting device, the gate electrode is required to have a smaller opening. The size of the opening of the gate electrode has a great influence on the electron beam diameter, and therefore, the opening of the gate electrode is required to be formed with high accuracy. However, when the size of the opening is outside the guaranteed range of accuracy of the production process, the size of the opening cannot be provided with high accuracy. Namely, the ratio of the opening diameter of the gate electrode to the distance between the electron-emitting member surface and the gate electrode surface cannot approach 1:1.

In this embodiment, the second electrode 2*c* is provided, whereby, even when the above ratio cannot approach 1:1, a high electron emission density can be obtained. In the example of FIG. 1A, the second electrode 2*c* is provided in an island shape in the opening of the first electrode 2*b*. In the example of FIG. 1A, although the second electrode 2*c* is separated from the first electrode 2*b*, a part of the second electrode 2*c* may be in contact with the first electrode 2*b*. The second electrode 2*c* may be provided so that the length of the contour of the exposed region of the electron-emitting member 5 is increased.

Figure 3E:
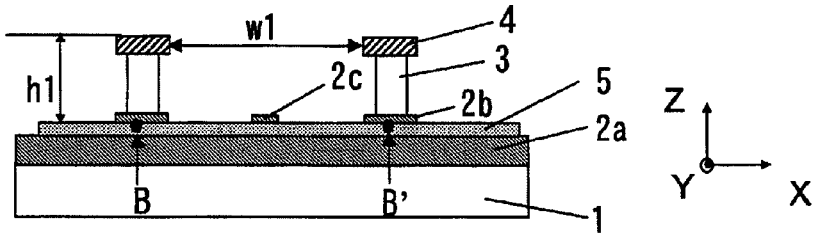
FIG. 3E is a cross-sectional view of the electron-emitting device according to the present embodiment.
Figure 3F:
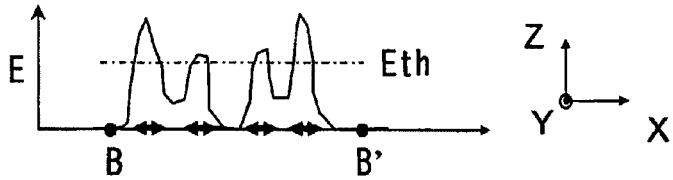
FIG. 3F is a graph showing a distribution of the electric field intensity applied to the vicinity of the surface of the electron-emitting member shown in FIG. 3E.

As described above, when the second electrode 2*c* is provided, the cross section shown in FIG. 3E can be obtained. The distribution of the electric field intensity near the surface of the electron-emitting member 5 in the cross section shown in FIG. 3E is shown in FIG. 3F. Specifically, the distribution of the electric field intensity near the surface of the electron-emitting member 5 is large not only in the region corresponding to the periphery of the contour of the opening of the gate electrode 4, but also at the periphery of the contour of the second electrode 2*c*. Namely, not only the region corresponding to the periphery of the contour of the opening of the gate electrode 4 but also the periphery of the contour of the second electrode 2*c* becomes the emission region. Therefore, a higher electron emission density can be obtained in comparison with the case in which electrons are emitted from only the region corresponding to the periphery of the contour of the opening of the gate electrode.

FIGS. 4A to 4F are views showing an example of a manufacturing method of the electron-emitting device according to this embodiment shown in FIGS. 1A and 1B.

Hereinafter, the example of the manufacturing method of the electron-emitting device according to this embodiment is described with reference to FIGS. 4A to 4F.

Figure 4A:
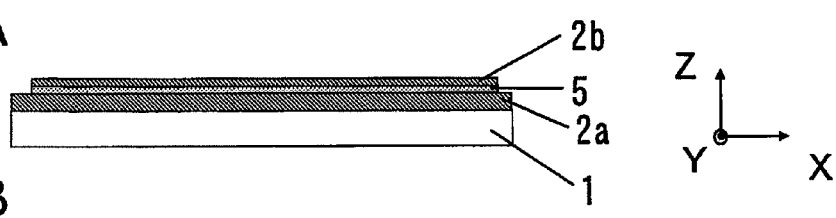
FIGS. 4A to 4F are views showing an example of a manufacturing method of the electron-emitting device according to the present embodiment.

First, the cathode electrode 2*a* is formed on the substrate 1 with a sufficiently cleaned surface (FIG. 4A). The substrate 1 is suitably selected from quartz glass, glass with a reduced content of an impurity such as Na, soda-lime glass, a silicon substrate, a laminated body with $SiO_2$ formed on for example a silicon substrate by sputtering or other means, an insulating substrate of ceramics such as aluminum, and so on.

The cathode electrode 2*a* has generally an electroconductivity and is formed by a general vacuum film-formation technique such as an evaporation method and a sputtering method or a photolithography technique. A material for the cathode electrode 2*a* is suitably selected from, for example, metal, alloy, carbide, boride, nitride, a semiconductor, an organic polymeric material, amorphous carbon, graphite, diamond-like carbon, carbon and carbon compound with diamond dispersed therein, and so on. As the metal, Be, Mg, Ti, Zr, Hf, V, Nb, Ta, Mo, W, Al, Cu, Ni, Cr, Au, Pt, Pd or the like may be used. The alloy may be generated by use of these metals. As the carbide, TiC, ZrC, HfC, TaC, SiC, WC, or the like may be used. As the boride, $HfB_2$, $ZrB_2$, $LaB_6$, $CeB_6$, $YB_4$, $GdB_4$, or the like may be used. As the nitride, TiN, ZrN, HfN, or the like may be used. As the semiconductor, Si, Ge, or the like may be used. The thickness of the cathode electrode 2*a* is set in a range from several tens nm to several mm, and preferably selected in a range from several hundreds nm to several μm.

Incidentally, a part of an insulating silicon substrate is rendered electroconductive by doping, and the electroconductive part may be used as the cathode electrode 2*a*.

The cathode electrode 2*a* may have a multilayer structure in which plural layers having different compositions are laminated. Some of the plural layers may be a high resistant layer.

Next, the electron-emitting member 5 is deposited on the entire surface of the cathode electrode 2*a* (FIG. 4A).

The electron-emitting member 5 is formed by, for example, a general film-formation technique such as an evaporation method, a sputtering method, and a plasma CVD method. As the material for the electron-emitting member 5, a material with a low work function is preferably selected. For example, the material for the electron-emitting member 5 is suitably selected from amorphous carbon, graphite, diamond-like carbon, carbon and carbon compound with diamond dispersed therein, and so on. The thickness of the electron-emitting member 5 is set in a range from several nm to several hundreds nm, and preferably selected in a range from several nm to several tens nm.

The electron-emitting member 5 is required to be electrically connected to the cathode electrode 2*a*, and therefore, it is preferable that the electron-emitting member 5 has an electroconductivity. For example, when an insulating material is used as the electron-emitting member, the electroconductivity should be added to the insulating material by doping. The electron-emitting member 5 itself may be an electroconductive material.

Next, the first electrode 2*b* is deposited on the electron-emitting member 5 (FIG. 4A).

The first electrode 2*b* may be formed of the same material as the cathode electrode 2*a* or may be formed of a different material. The film thickness of the first electrode 2*b* can be suitably designed. If the film thickness is increased, the focusing effect is increased, but the electric field intensity applied to the film surface is reduced, whereby the emission area is reduced (the electron emission density is reduced).

The first electrode 2*b* is electrically connected to the cathode electrode 2*a* so as to have the same electrical potential as the cathode electrode 2*a*. When the electron-emitting member has an electroconductivity, the first electrode 2*b* and the cathode electrode 2*a* are formed across the electron-emitting member, whereby the first electrode 2*b* and the cathode electrode 2*a* can have the same electrical potential. When the electron-emitting member has a high insulating property, the first electrode 2*b* and the cathode electrode 2*a* are in contact with each other in an opening (formed in the following process) of the electron-emitting device or at the periphery of the opening, whereby they may be electrically connected to each other. According to this constitution, these electrodes can have the same electrical potential.

Figure 4B:
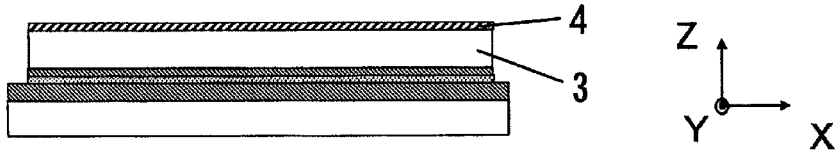

Next, the insulating layer 3 and the gate electrode 4 are formed in this order on the first electrode (FIG. 4B).

The insulating layer 3 is formed by a general vacuum film-formation technique such as a sputtering method, a CVD method, or a vacuum deposition method. The thickness of the insulating layer 3 is set in a range from several nm to several μm, preferably selected in a range from several tens nm to several hundreds nm. A material having high voltage resistance such as $SiO_2$, SiN, $Al_2O_3$, and CaF having high electric field resistance is preferably used for the insulating layer 3.

The gate electrode 4 has an electroconductivity as with the first cathode electrode 2*a* and is formed by a general vacuum film-formation technique such as a evaporation method and a sputtering method or a photolithography technique. A material for the gate electrode 4 is suitably selected from, for example, metal, alloy, carbide, boride, nitride, a semiconductor, and an organic polymeric material, and so on. As the metal, Be, Mg, Ti, Zr, Hf, V, Nb, Ta, Mo, W, Al, Cu, Ni, Cr, Au, Pt, Pd, or the like may be used. The alloy may be generated by use of these metals. As the carbide, TiC, ZrC, HfC, TaC, SiC, WC, or the like may be used. As the boride, $HfB_2$, $ZrB_2$, $LaB_6$, $CeB_6$, $YB_4$, $GdB_4$, or the like may be used. As the nitride, TiN, ZrN, HfN, or the like may be used. As the semiconductor, Si, Ge, or the like may be used.

Next, each opening of the gate electrode 4, the insulating layer 3, and the first electrode is formed. In this embodiment, a tubular opening is formed, and a first electrode in the tubular opening is a second electrode. In other words, in the formation of the opening of the first electrode 2*b*, a part of the first electrode as the second electrode remains in the opening. In this embodiment, although the part of the first electrode is the second electrode, the second electrode may be formed independently from the first electrode. In this case, the cathode electrode, the first electrode, and the second electrode may be formed of the same material, may be formed of different materials, or any one pair of the three electrodes may be formed of the same material.

Figure 4C:
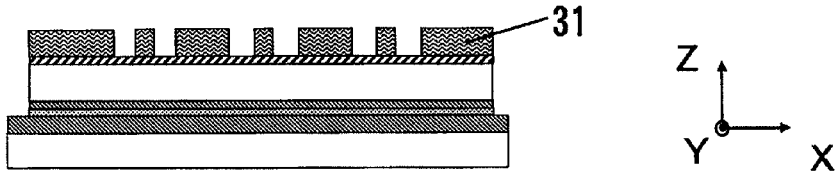

First, a mask pattern 31 is formed by the photolithography technique (FIG. 4C).

Figure 4D:
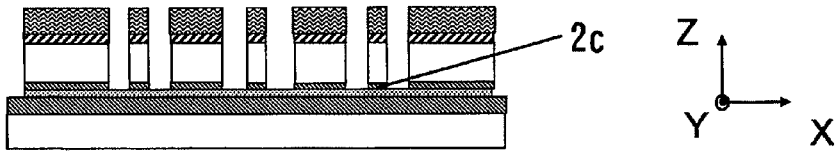

Next, the gate electrode 4, the insulating layer 3, and the first electrode 2*b* are etched in this order to form an opening (FIG. 4D). A dry etching method, a wet etching method, or other etching method is suitably selected depending on the material and thickness of the gate electrode 4, the insulating layer 3, and the first electrode 2*b*. Furthermore, a microfabrication for partial etching such as focusing ion beam etching may be suitably selected depending on the situation.

Figure 4E:
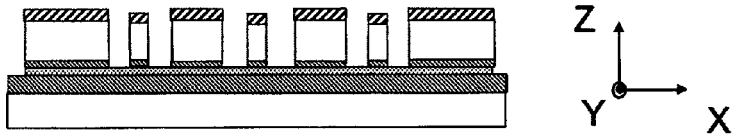
Figure 4F:
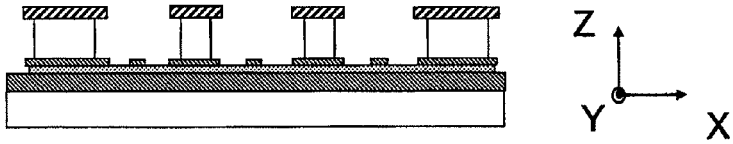

Next, the mask pattern 31 is peeled (FIG. 4E).

The insulating layer 3 is then subjected to wet etching (FIG. 4F), whereby the insulating layer 3 inside the opening is completely removed. The opening has a tubular shape, and therefore, when the insulating layer 3 inside the opening is removed, the gate electrode 4 on the insulating layer 3 is also removed.

The size of the opening of the gate electrode 4 and the size of the opening of the focusing electrode have a great influence on the electron beam diameter and thus are important. Specifically, each size of the openings is preferably from several tens nm and several tens μm, particularly from 100 nm to 1 μm.

In this embodiment, although the electron-emitting member 5 is formed on the entire surface of the cathode electrode 2*a*, it may be formed on only the exposed part. Such a constitution can be obtained by, for example, performing the step of forming the electron-emitting member 5 next to the step of forming each opening of the gate electrode 4, the insulating layer 3, and the first electrode 2*b*.

In this way, the electron-emitting device according to this embodiment can be easily produced by a very simple process in which each layer is formed to be etched.

Plural electron-emitting devices which have layers with a large area and are produced on one substrate can be easily applied to a large image display apparatus and so on. The substrate on which the plural electron-emitting devices are provided is cut into plural pieces, whereby the electron-emitting devices can be used in a large number of apparatuses. Therefore, both large and small apparatuses can be manufactured at relatively low cost.

Application Examples

The application examples of the electron-emitting device according to this embodiment are described hereinafter. For example, an electron source having plural electron-emitting devices according to this embodiment and an image display apparatus having the electron source can be constituted.

(Electron Source)

First, the electron source which can be obtained by arranging a plurality of the electron-emitting devices according to the present embodiment on a substrate is described. The electron-emitting devices adopt various arrangements. As an example, a plurality of the electron-emitting devices are arranged in a matrix form along an X direction and a Y direction. One electrode of respective electron-emitting devices arranged in the same row is commonly connected to a wiring in the X direction, and the other electrode of respective electron-emitting devices arranged in the same column is commonly connected to a wiring in the Y direction. Such an arrangement is called a simple matrix arrangement. Hereinafter, the simple matrix arrangement is described in detail.

Figure 5:
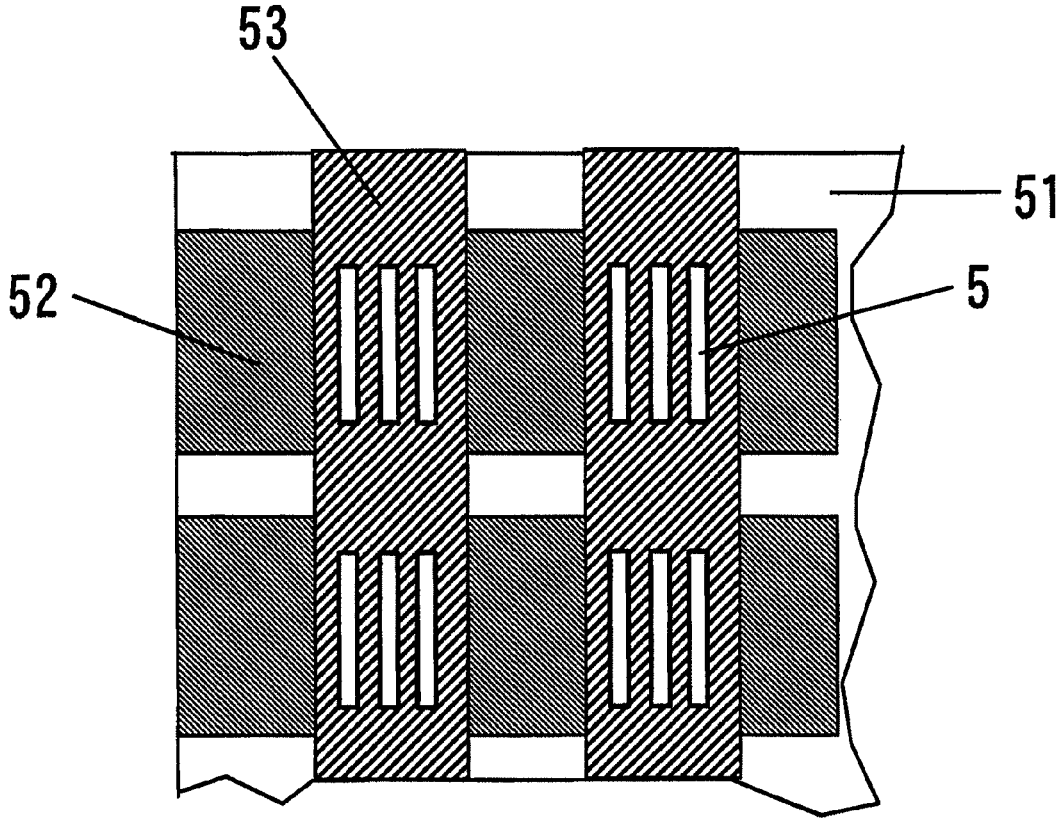
FIG. 5 is a view showing an example of an electron source according to the present embodiment.
Figure 6:
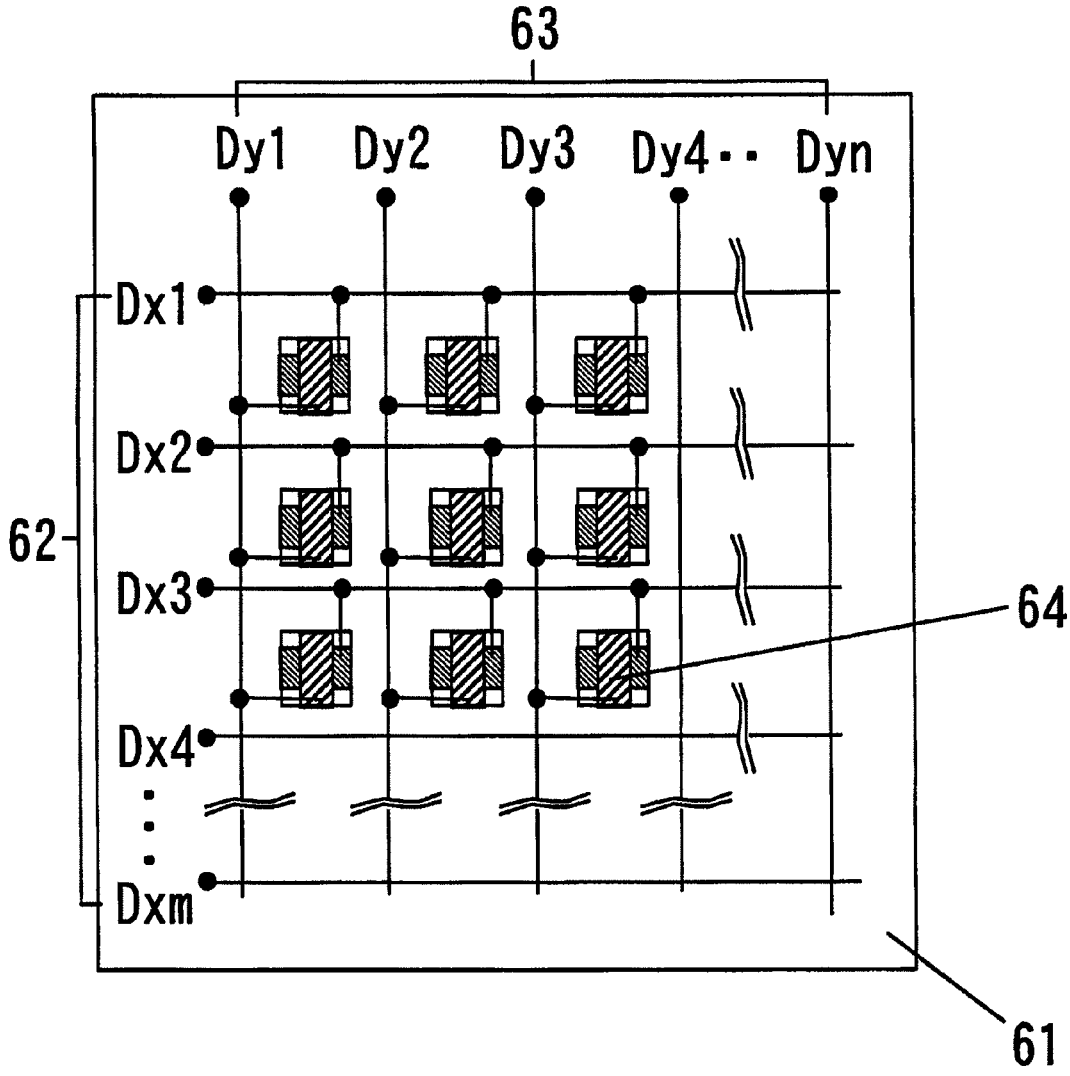
FIG. 6 is a view showing an example of an electron source according to the present embodiment.

In FIGS. 5 and 6, reference numerals 51 and 61 are electron source substrates, reference numerals 52 and 62 are X-directional wirings, and reference numerals 53 and 63 are Y-directional wirings. A reference numeral 64 is the electron-emitting device according to the present embodiment.

The X-directional wiring 62 includes m wirings of Dx1, Dx2, . . . , and Dxm and can be constituted of electroconductivity metal formed using a vacuum evaporation method, a printing method, a sputtering method, or the like. The material, film thickness, and width of the wirings are suitably designed. The Y-directional wiring 63 includes n wirings of Dy1, Dy2, . . . , and Dyn and is formed in the same way as the X-directional wiring 62. These m X-directional wirings 62 and n Y-directional wirings 63 have an interlayer insulating layer (not shown) therebetween, and the interlayer insulating layer electrically separates these wirings (numbers m and n are positive integers).

The interlayer insulating layer (not shown) is constituted of $SiO_2$ and so on formed using a vacuum evaporation method, a printing method, a sputtering method, or the like. For example, the interlayer insulating layer is formed with a predetermined shape on the entire or a part of the surface of the electron source substrate 61 on which the X-directional wirings 62 are formed. In particular, the film thickness, material, and production method are suitably set so that the interlayer insulating layer can resist a potential difference in the intersection of the X-directional wiring 62 and the Y-directional wiring 63. The X-directional wiring 62 and the Y-directional wiring 63 are respectively drawn as external terminals.

In some cases, the m X-directional wiring 62 constituting of an electron-emitting device 64 doubles as the cathode electrode 2, the n Y-directional wiring 63 doubles as the gate electrode 4, and the interlayer insulating layer doubles as the insulating layer 3.

The X-directional wiring 62 is connected with scanning signal applying means (not shown). The scanning signal applying means applies a scanning signal to the electron-emitting device 64 connected to the selected X-directional wiring. Meanwhile, the Y-directional wiring 63 is connected with modulation signal generation means (not shown). The modulation signal generation means applies a modulation signal, modulated in response to an input signal, to each line of the electron-emitting device 64. The driving voltage applied to each electron-emitting device is supplied as a differential voltage between the scanning signal and the modulation signal applied to the electron-emitting device.

(Image Display Apparatus)

Figure 7:
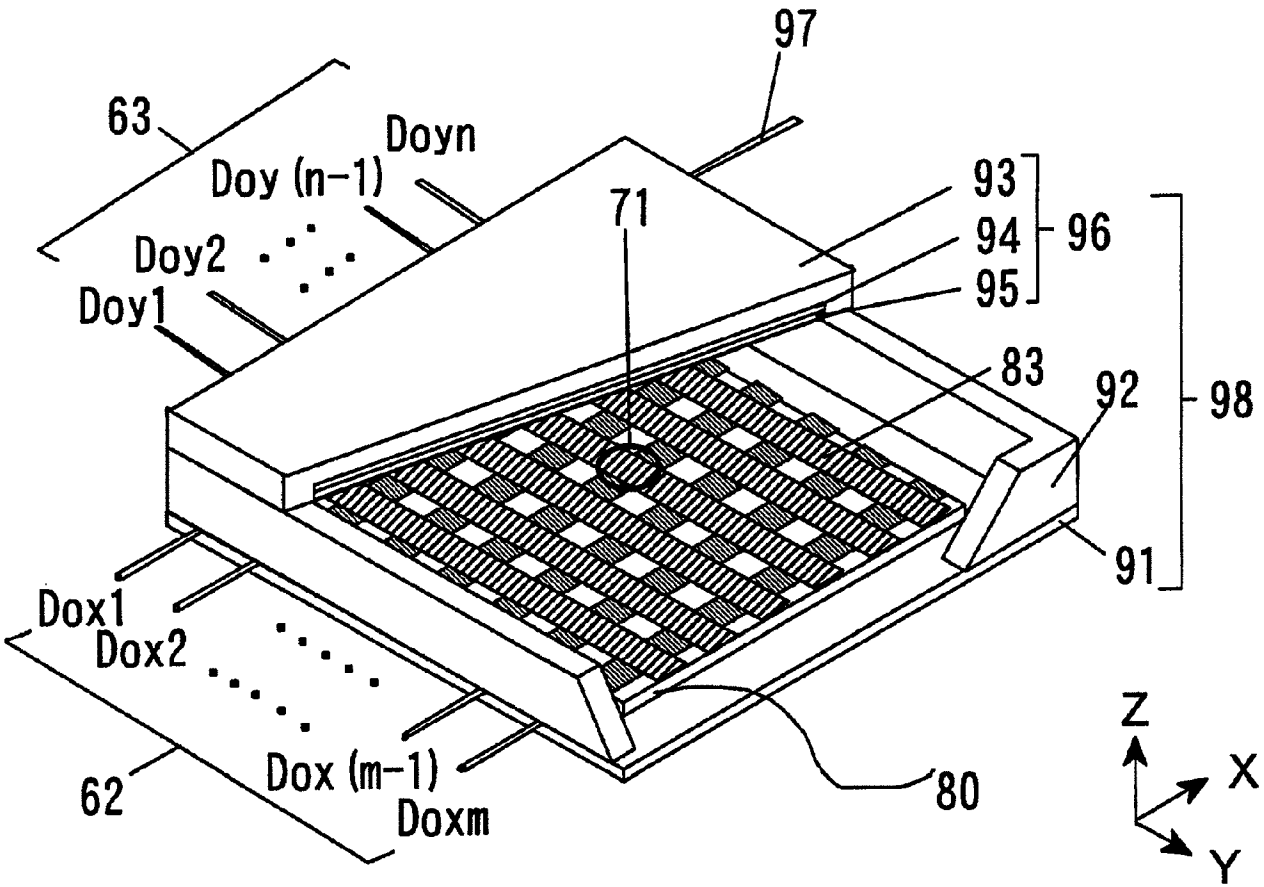
FIG. 7 is a schematic view showing an example of a display panel of an image display apparatus according to the present embodiment.

In the above constitution, by use of the simple matrix wiring, the electron-emitting devices are individually selected to be allowed to be independently driven. An image display apparatus constituted by using the above electron source is described using FIG. 7. FIG. 7 is a schematic view showing an example of a display panel of the image display apparatus.

In FIG. 7, a reference numeral 71 is an electron-emitting device, reference numeral 80 is an electron source substrate, reference numeral 91 is a rear plate, reference numeral 96 is a face plate, and reference numeral 92 is a support frame. A plurality of the electron-emitting devices 71 are arranged on the electron source substrate 80. The electron source substrate 80 is fixed to the rear plate 91. The face plate 96 is constituted of a glass substrate 93, a phosphor film 94, a metal back 95, and so on. The phosphor film 94 and the metal back 95 are provided inside the glass substrate 93. In the example in FIG. 7, the phosphor film 94 is provided on the inner surface of the glass substrate 93 (on the surface of the inside of the glass substrate 93), and the metal back 95 is provided on the inner surface of the phosphor film 94. The rear plate 91 and the face plate 96 are joined with the support frame 92 through a flit glass and so on.

An external container 98 is constituted of the face plate 96, the support frame 92, and the rear plate 91. The rear plate 91 is provided for the main purpose of reinforcing the intensity of the electron source substrate 80, and therefore, when the electron source substrate 80 itself has a sufficient intensity, the separately provided rear plate 91 can be omitted. In other words, the electron source substrate 80 and the rear plate 91 may be integrally constituted as one member.

The flit glass is applied onto the junction surface (bonding surface) between the face plate 96, the rear plate 91 and the support frame 92. Then, face plate 96, the rear plate 91, and the support frame 92 are aligned at a predetermined position to be fixed, and, thus, to be heated, whereby the flit glass is fired and thus to be sealed.

As the means for heating the flit glass, lamp heating using an infrared lamp and the like, a hot plate, or the like can be applied; however, it is not limited to those.

Further, a bonding material for bonding plural members, constituting the external container, by heating is not limited to the flit glass, and if a sufficient vacuum state can be maintained after the sealing, any bonding materials can be applied.

The above external container is one embodiment of this invention, but this invention is not limited thereto and it can also be applied to various external containers.

As another example, the support frame 92 is sealed directly to the electron source substrate 80, and the external container 98 may be constituted of the face plate 96, the support frame 92, and the electron source substrate 80. Meanwhile, a support member called a spacer is provided between the face plate 96 and the rear plate 91, whereby the external container 98 with a sufficient intensity against atmospheric pressure can be constituted.

Figure 8A:
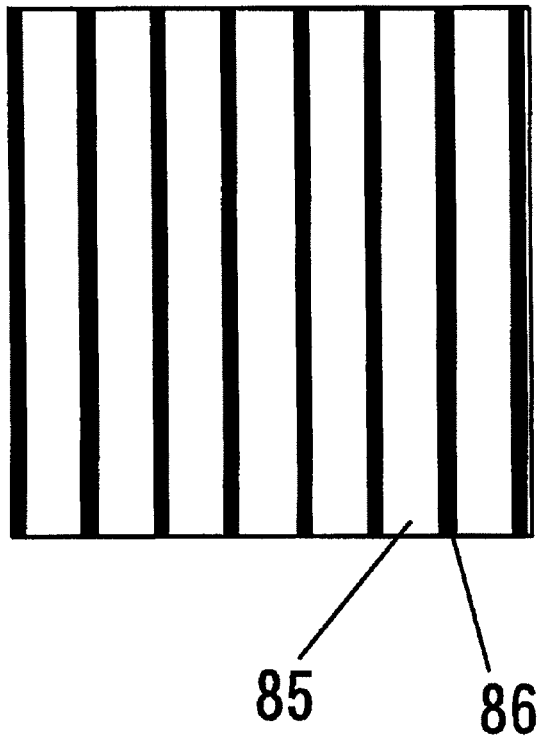
FIG. 8A is an example in which black stripes are formed on a face plate.
Figure 8B:
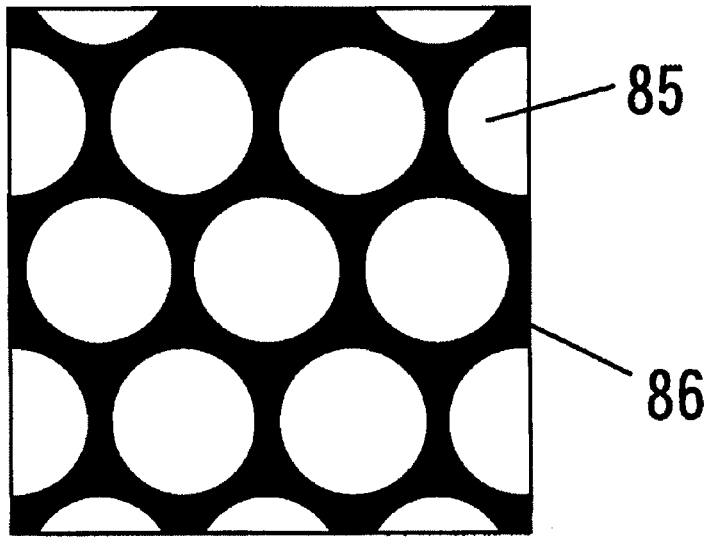
FIG. 8B is an example in which a black matrix is formed on the face plate.

FIGS. 8A and 8B are schematic views of the phosphor film 94 formed on the face plate 96. The phosphor film 94 is an image forming member for forming an image by electrons emitted from the electron source. The image forming member is, for example, a phosphor emitting light due to the collision of electrons. A monochrome phosphor film can be constituted of only a phosphor 85, and a color phosphor film can be constituted of a black electroconductive material 86 called, such as a black stripe (FIG. 8A) and a black matrix (FIG. 8B), and the phosphor 85.

There are two objects to provide the black matrix and the black stripe. One object is to render color mixture unnoticeable by blackening a part where each phosphor 85 of three primary colors phosphor required for color display is separately coated. Another object is to prevent decreasing of contrast due to the reflection of external light on the phosphor film 94. The black stripe can be formed of an electroconductive material with small light transmission and small light reflection in addition to a material mainly composed of normally used graphite.

As a method for applying a phosphor onto the glass substrate 93, a precipitation method and a printing method, for example, can be applied regardless of monochrome or color. The metal back 95 is usually provided on the inner surface side of the phosphor film 94. The purpose of providing the metal back is, for example, to improve brightness by mirror face-reflecting light toward the inner surface side to the face plate 96 side from among luminance of the phosphor, to act as an electrode for applying an electron beam accelerating voltage, and to protect the phosphor film 94 from damages due to collision of negative ion generated inside the external container. After the phosphor film 94 has been produced, the surface on the inner surface side of the phosphor film 94 is smoothed (usually referred to as "filming"), and thereafter, Al is deposited on the phosphor film 94 by using the vacuum evaporation and the like, whereby the metal back 95 can be produced.

In order to enhance the electroconductivity of the phosphor film 94, the face plate 96 may further have a transparent electrode (not shown) provided on the outer surface side of the phosphor film 94.

In the image display apparatus according to this embodiment, the phosphor film 94 is disposed immediately above the electron-emitting device 71 on the ground that the electron-emitting device 71 emits electron beams immediately above.

Next, a vacuum sealing process for vacuum-sealing an external container subjected to the sealing process will be described.

In the vacuum sealing process, an external container 98 is first heated to be exhausted through an exhaust pipe (not shown) by means of an exhaust equipment such as an ion pump and a sorption pump, while being kept at 80 to 250° C. The exhaust pipe is then heated by a burner under the atmosphere with sufficiently small amount of an organic material to be melted, and, thus, to seal the external container 98. A getter processing can also be performed in order to keep the pressure after the sealing of the external container 98. The getter processing includes, immediately before the vacuum-sealing of the external container 98 or after the sealing, heating a getter disposed at a predetermined position (not shown) in the external container 98 by heating using resistance, high-frequency, or the like to form an evaporation film. The getter is usually mainly composed of Ba or the like and used for maintaining the atmosphere in the external container 98 according to an absorption action of the evaporation film.

In the image display apparatus constituted by using the electron source of the simple matrix arrangement and produced by the above process, a voltage is applied to each electron-emitting device through terminals outside the case Dox1 to Doxm and Doy1 to Doyn, whereby electrons are emitted.

A voltage is applied to the metal back 95 or a transparent electrode (not shown) through a high voltage terminal 97, whereby electron beams are accelerated.

The accelerated electrons collide against the phosphor film 94, and light is generated to form an image.

Figure 9:
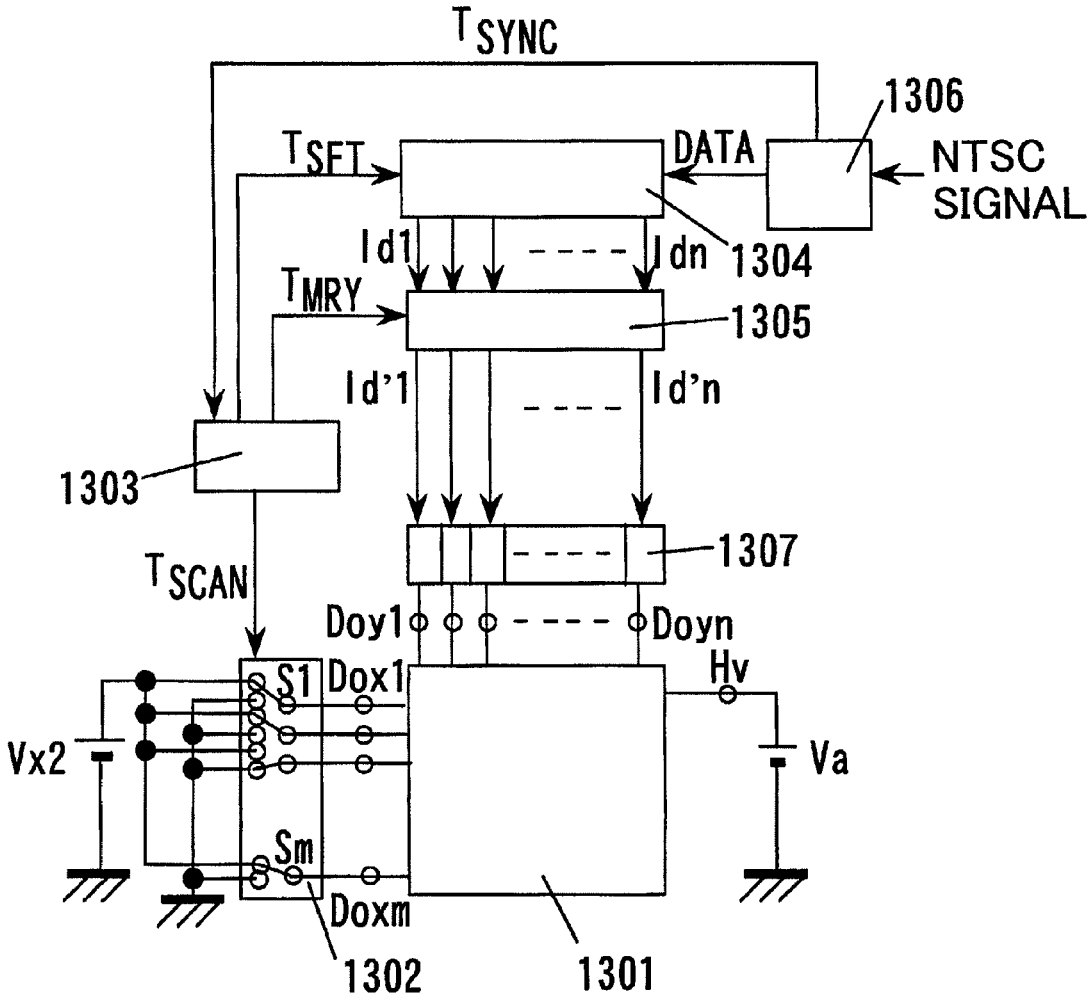
FIG. 9 is a block diagram showing an example of a drive circuit for performing display in response to an NTSC television signal.

FIG. 9 is a block diagram showing an example of a drive circuit for performing display in response to an NTSC television signal.

The drive circuit of FIG. 9 is described. This circuit is provided with M switching devices in its inside (in the drawing, the switching devices are schematically shown as S1 to Sm). Each of the switching devices selects one of an output voltage of the DC voltage source Vx1 and the DC voltage source Vx2 and is electrically connected to the terminals Dox1 to Doxm of a display panel 1301. The switching devices of S1 to Sm are operated based on a control signal Tscan outputted by a control circuit 1303 and can be constituted by combining a switching device such as an FET. The DC voltage source Vx1 is set based on the characteristics of the electron-emitting device.

The control circuit 1303 has a function of matching the operation of each section so that appropriate display is performed based upon an image signal inputted from the outside. The control circuit 1303 generates control signals of Tscan, Tsft, and Tmry for each section on the basis of a synchronizing signal Tsync sent from a synchronizing signal separation circuit 1306.

The synchronizing signal separation circuit 1306 is used for separating a synchronizing signal component and a luminance signal component from an NTSC television signal (NTSC signal) inputted from the outside and can be constituted by using a general frequency separation (filter) circuit and the like. Although the synchronizing signal, separated from the NTSC signal by the synchronizing signal separation circuit 1306, is formed of a vertical synchronizing signal and a horizontal synchronizing signal, it is illustrated as the Tsync signal for convenience's sake of explanation here. The luminance signal component of the image separated from the NTSC signal is represented as a DATA signal for convenience's sake. The DATA signal is inputted into a shift register 1304.

The shift register 1304 serial/parallel converts the DATA signal, which is inputted serially in time series, for every line of an image and operates based on the control signal Tsft sent from the control circuit 1303. Namely, it can be said that the control signal Tsft is a shift clock of the shift register 1304. The serial/parallel converted data for one line of an image (equivalent to drive data for N electron-emitting devices) is outputted as N parallel signals of Id1 to Idn to be input into a line memory 1305.

The line memory 1305 is a storage device for storing the data for one line of an image only for a necessary time and suitably stores contents of Id1 to Idn in accordance with the control signal Tmry sent from the control circuit 1303. The stored contents are output as Id'1 to Id'n and input in a modulation signal generator 1307.

The modulation signal generator 1307 is a signal source of modulation signal for suitably driving and modulating the electron-emitting devices according to the present embodiment in accordance with the image data Id'1 to Id'n. The output signal from modulation signal generator 1307 is applied to the electron-emitting device in the display panel 1301 through the terminals Doy1 to Doyn.

When a pulsing voltage is applied to the present electron-emitting device, electrons are not emitted even if voltage not more than electron emission voltage is applied. However, if a voltage not less than the electron emission voltage is applied, electron beams are output. In this case, a pulse crest value Vm is varied, whereby the intensity of the output electron beams can be controlled. In addition, the pulse width Pw is changed, whereby the total charge of the output electron beams can be controlled.

Thus, a voltage modulation system, a pulse width modulation system, and the like can be adopted as a system for modulating the electron-emitting device according to an input signal. When the voltage modulation system is adopted, a voltage modulation system circuit, which generates a voltage pulse of a fixed length to suitably modulate a pulse crest value according to data input therein, can be used as a modulation signal generator 1307.

When the pulse width modulation system is adopted, a pulse width modulation circuit, which generates a voltage pulse of a fixed crest value to suitably modulate the width of the voltage pulse according to data to be input, can be used as the modulation signal generator 1307.

As the shift register 1304 and the line memory 1305, those of both a digital signal system and an analog signal system can be adopted. This is because serial/parallel conversion and storage of an image signal only have to be performed at a predetermined speed.

When the digital signal system is used, the output signal DATA of the synchronizing signal separation circuit 1306 is required to be changed into a digital signal. For this purpose, an A/D converter may be provided in an output section of the synchronizing signal separation circuit 1306. In relation to this, a circuit used in the modulation signal generator 1307 is slightly different depending on whether the output signal of the line memory 1305 is a digital signal or an analog signal. Specifically, in the case of the voltage modulation system using a digital signal, for example, an D/A conversion circuit is used for the modulation signal generator 1307 and, if necessary, an amplification circuit or the like is added thereto. In the case of the pulse width modulation system, for example, a circuit, in which a high-speed oscillator, a counter for counting a wave number to be output by the high-speed oscillator, and a comparator for comparing an output value of the counter and an output value of the line memory are combined, is used as the modulation signal generator 1307. According to need, it is also possible to add an amplifier for amplifying the voltage of a modulation signal, which is subjected to the pulse width modulation to be output by the comparator, to a drive voltage of the electron-emitting device in the present embodiment.

In the case of the voltage modulation system using an analog signal, for example, an amplification circuit using an operational amplifier or the like can be adopted as the modulation signal generator 1307 and, if necessary, a level shift circuit or the like can be added thereto. In the case of the pulse width modulation system, for example, a voltage control oscillation circuit (VCO) can be adopted and, if necessary, an amplifier for amplifying a voltage to a drive voltage of the electron-emitting device in the present embodiment can be added thereto.

The constitution of the image display apparatus described above is an example of the image display apparatus to which this invention is applicable, and the constitution can be variously modified based on the technical idea of this invention. As to an input signal, although the NTSC system is described as an example, the input signal is not limited to this and, other than a PAL system and an SECAN system, it is also possible to adopt a TV signal (e.g., high definition TV typified by an MUSE system or the like) system constituting of more scanning lines than those of the PAL and SECAM systems.

The electron-emitting device of this invention can also be used in an image forming apparatus as an optical printer constituted by using a photosensitive drum and so on other than as a display device.

Examples

Hereinafter, examples of this invention will be described in detail.

First Example

As a first example of this invention, a example of a manufacturing method of the electron-emitting device according to the present embodiment will be described using FIGS. 4A to 4F.

(Step 1)

First, a PD 200 glass was used as the substrate 1. The substrate 1 was sufficiently cleaned, and thereafter, Ta with a thickness of 800 nm as the cathode electrode 2*a* was formed.

(Step 2)

Next, diamond-like carbon with a thickness of about 30 nm as the electron-emitting member 5 was deposited on the entire surface of the cathode electrode 2*a* by a plasma CVD method. A $CH_4$ gas was used as a reaction gas.

(Step 3)

Subsequently, Ta with a thickness of 100 nm as the first electrode 2*b* was formed on the electron-emitting member 5. Further, $SiO_2$ with a thickness of 1 μm as the insulating layer 3 is deposited on the first electrode, and Pt with a thickness of 200 nm as the gate electrode 4 was deposited on the insulating layer 3.

(Step 4)

Next, the mask pattern 31 of a resist was formed on the gate electrode 4 by using a photolithography method.

This example provides a constitution which can be realized by patterning using the photolithography method with accuracy guaranteed as long as the length is not less than 3.5 μm. The pattern has a tubular opening surrounded by two quadrangular areas in which the length of two outer sides P3 and L3 are respectively P1+2×P2=9 μm and L1+2×L2=32 μm and the length of two inner sides P1 and L1 are respectively 2 μm and 25 μm. Plural openings, in which the width P2 (X direction)=L2 (Y direction)=3.5 μm and the pitch P5 in the X direction=P3+P4=12.5 μm, are formed. Therefore, as shown in FIG. 1A, when a mask pattern having the three openings are formed in one electron-emitting device, the distance from the end to end of the opening is 34 μm.

Since the length (width) P1 is outside the guaranteed range of the patterning accuracy, the line width is not guaranteed. However, even if the accuracy of the width P1 is not high, a high emission current with a small electron beam diameter can be obtained. Specifically, the size of the opening of the gate electrode, the size of the opening of the insulating layer immediately under the gate electrode, and the size of the opening of the first electrode have a great influence on the electron beam diameter, and therefore, each opening size should be within the guaranteed range of the patterning accuracy. However, the gate electrode and the insulating layer in the portion of the width P1 are removed in the following step, and therefore, the width P1 does not have a great influence on the electron beam diameter, and does not have to be within the guaranteed range of the patterning accuracy.

(Step 5)

Next, the Pt gate electrode 4 was dry etched by Ar plasma etching using the mask pattern 31 as a mask, and the insulating layer 3 and the first electrode 2*b* were dry etched with a $CF_4$ gas using the mask pattern 31 as a mask, whereby the gate electrode 4, the insulating layer 3, and the first electrode 2*b* in the area other than the masked area were removed. According to this, a tubular opening surrounded by two quadrangular areas was formed, and, at the same time, a first electrode corresponding to the inside quadrangular area could be formed as the second electrode 2*c*.

(Step 6)

The mask pattern 31 was then peeled, and the electron-emitting device being produced was sufficiently cleaned.

(Step 7)

Next, wet etching was performed with buffered hydrofluoric acid. $SiO_2$ of 1 μm was etched by controlling the etching time. According to this step, $SiO_2$ with the width P1 of 2 μm (all the $SiO_2$ with the width P1) was etched from the both sides, and the gate electrode 4 on the $SiO_2$ was also removed. Meanwhile, the insulating layer 3 was partially etched. Thus, the opening of the insulating layer became larger in size than the opening of the gate electrode.

The electron-emitting device according to this example can be produced by the above steps.

Figure 14A:
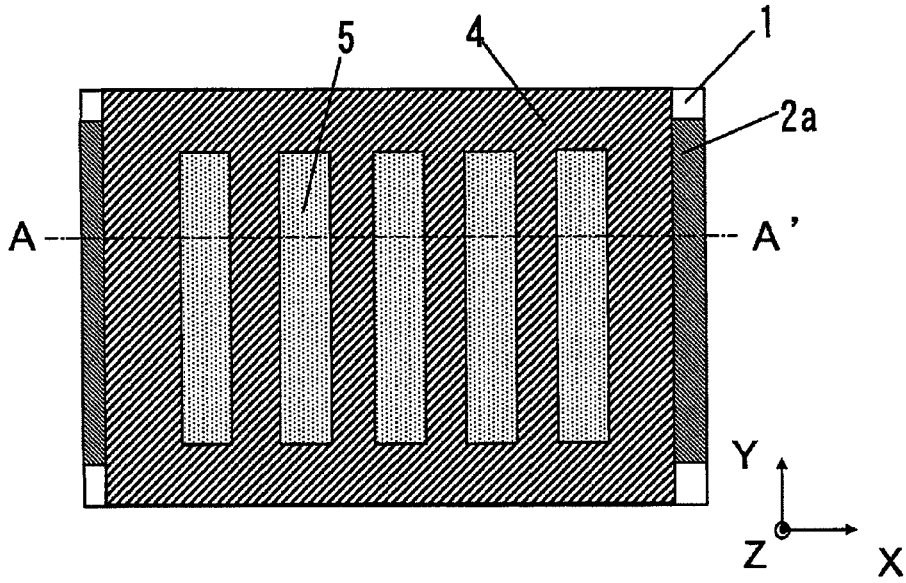
FIGS. 14A and 14B are schematic views of an electron-emitting device used for the comparison with the electron-emitting device produced in a first example.
Figure 14B:
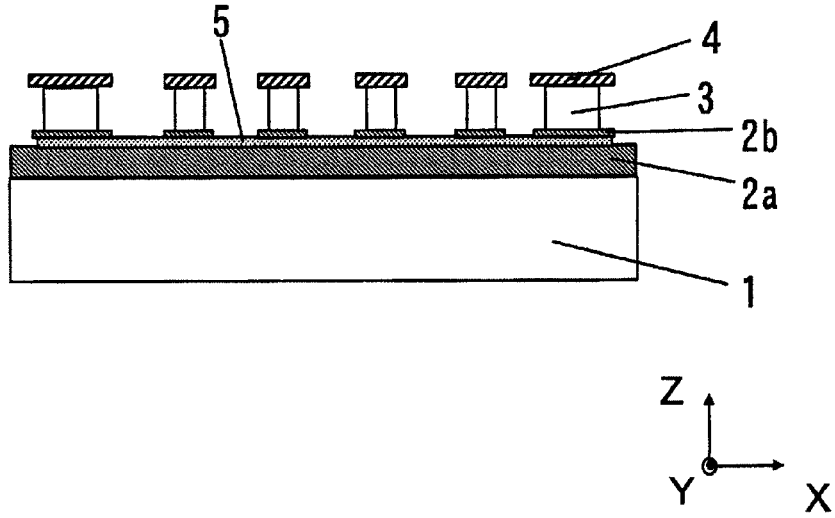

An electron-emitting device (a comparison device) was provided for comparison with the electron-emitting device (the present device) produced in this example. In the comparison device, the width (P3) of the opening is 3.5 μm, the length of the opening (L3) is 32 μm, the distance to the adjacent opening (P4) is 3.5 μm, and the opening pitch (P5) is 7 μm. The schematic view of the comparison device is shown in FIG. 14.

If the size of the comparison device and the size of the present device are the same as each other, the length from the end to end of the opening is 34 μm, and therefore, five openings are formed in the comparison device.

As shown in FIG. 2, an anode electrode is provided above the present device and the comparison device to be driven. Here, a distance H=2 mm, an anode voltage Va=10 kv, a drive voltage Vg=40 V.

As a result of driving the both devices, the emission current in the present device was larger by about 5% than the emission current in the comparison device. It is considered that this is because the area (portion) to which an effective voltage is applied is increased in one opening. Specifically, the present device has the second electrode, and therefore, a large electric field intensity can be obtained not only a region corresponding to the periphery of the contour of the opening of the gate electrode 4, but also at the periphery of the contour of the second electrode 2*c* on the surface of the electron-emitting member. However, the electric field intensity in the region corresponding to the periphery of the contour of the opening of the gate electrode 4 is larger than the electric field intensity at the periphery of the contour of the second electrode 2*c*. Thus, in the present device, the length of the contour which can provide a large electric field intensity is 408 μm (3×(P3×L2+(L1+2×L2)×2+P1×2+L1×2)). Meanwhile, in the comparison device, the length of the contour which can provide a large electric field intensity is 355 μm (5×(P3×2+L3×2)). It is considered that since the length of the contour in the present device which can provide a large electric field intensity is larger than that in the comparison device, the emission current becomes larger. Namely, a third cathode electrode is provided so that the length of the contour of the exposed region of the electron-emitting member is increased, whereby a high emission current can be obtained.

The constitution of the electron-emitting device of this example is effective especially in the case in which an opening smaller than the range in which accuracy is guaranteed is required in the photolithography process in order to obtain a large electron emission amount. In other words, when the ratio of the above-mentioned opening diameter of the gate electrode to the distance between the surface of the electron-emitting member and the surface of the gate electrode cannot approach 1:1, the constitution of this example is more advantageous than the constitution of the comparison device.

In the electron-emitting device having an opening, the cathode electrode and the gate electrode are opposed to each other with the insulating layer provided between them in order to form the opening, and therefore, a capacity is generated therebetween. This capacity is causative of the occurrence of the signal delay at the time of driving the device. If the capacity is large, the response to a short pulse signal is deteriorated. However, the capacity of the insulating layer in the present device was reduced to ⅘ of the comparison device. Therefore, the present device can provide a favorable response (linear response) for a driving waveform of 1 μsec to 1 msec. Meanwhile, in the comparison device, the response to the waveform of 1 μsec was deteriorated.

When the electron-emitting device is applied to a large image display apparatus, a large number of devices and a long wiring cause the increasing of the signal delay due to the capacity. Thus, gradation is deteriorated, or an electrical circuit for correcting gradation becomes complex. The capacity of the device of this example is smaller than the capacity of the comparison device, and therefore, the electron source and the image display apparatus using the present device can realize the high definition.

Second Example

Figure 10A:
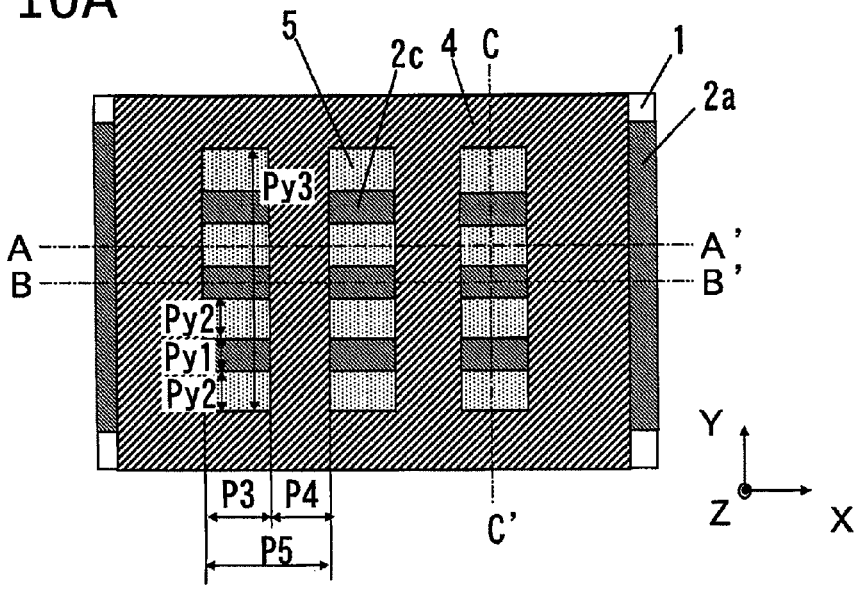
FIG. 10A is a plan view of an electron-emitting device according to a second example as viewed from above a cathode electrode.
Figure 10B:
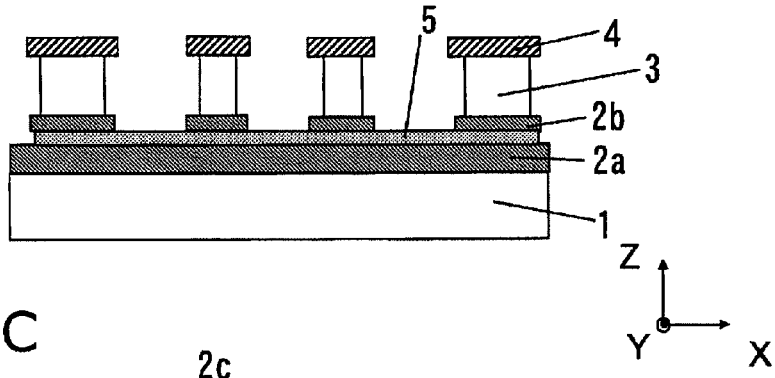
FIG. 10B is an A-A' cross-sectional view of FIG. 10A.
Figure 10C:
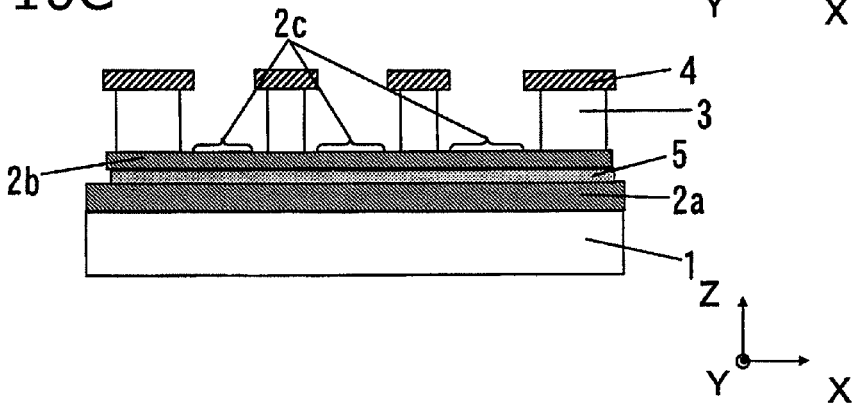
FIG. 10C is a B-B' cross-sectional view of FIG. 10A.

In this example, the second electrode is provided so as to divide the opening of the first electrode into plurals. According to this constitution, the length of the contour of the exposed region of the electron-emitting member can be increased. FIGS. 10A to 10C are schematic views of the electron-emitting device according to the second example. FIG. 10A is a plan view of electron-emitting device as viewed from above a cathode electrode (the side from which electrons are emitted). FIG. 10B is an A-A' cross-sectional view of FIG. 10A. FIG. 10C is a B-B' cross-sectional view of FIG. 10A. FIGS. 11A to 11F show an example of a manufacturing method of the electron-emitting device according to this example. FIGS. 11A to 11F are C-C' cross-sectional views of FIG. 10A.

FIGS. 10A to 10C show an electron-emitting device including a cathode electrode, a first electrode, an insulating layer, a gate electrode, and an electron-emitting member. The electron-emitting member, the first electrode, the insulating layer, and the gate electrode are formed in this order on the cathode electrode. The gate electrode and the insulating layer have a first opening, and the first electrode has plural second openings for exposing the electron-emitting member in the first opening.

(Step 1)

First, a PD 200 glass was used as the substrate 1. The substrate 1 was sufficiently cleaned, and thereafter, Ta with a thickness of 800 nm as the cathode electrode 2*a* was formed.

(Step 2)

Next, diamond-like carbon with a thickness of about 30 nm as the electron-emitting member 5 was deposited on the entire surface of the cathode electrode 2*a* by the plasma CVD method. A $CH_4$ gas was used as a reaction gas.

(Step 3)

Figure 11A:
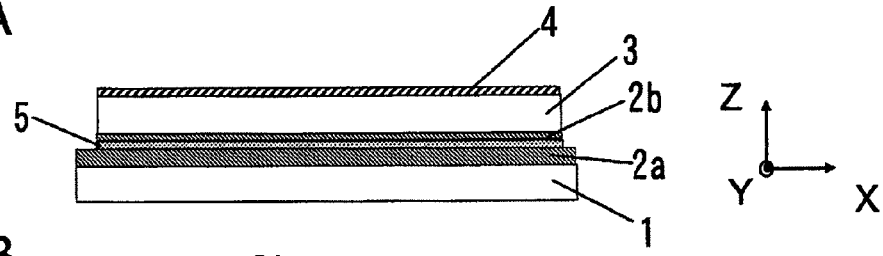
FIGS. 11A to 11F are views showing an example of a manufacturing method of the electron-emitting device according to the second example.

Subsequently, Ta with a thickness of 100 nm as the first electrode 2*b* was formed on the electron-emitting member. Further, $SiO_2$ with a thickness of 1 μm as the insulating layer 3 was deposited on the first electrode 2*b*, and Pt with a thickness of 200 nm as the gate electrode 4 was deposited on the insulating layer 3 (FIG. 11A).

(Step 4)

Figure 11B:
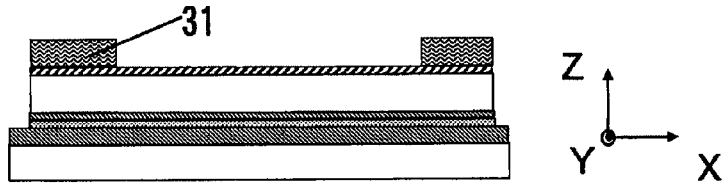

Next, the mask pattern 31 of resist as a mask to be used in the formation of the opening of the gate electrode was formed by using the photolithography method (FIG. 11B). The pattern has a rectangular opening with two sides Py3=20 μm and P3=5 μm. A plurality of the openings in which the opening pitch in the X direction P5=10 μm are provided (FIG. 10A).

(Step 5)

Figure 11C:
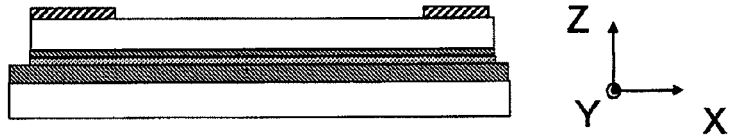

The Pt gate electrode 4 was subjected to Ar plasma etching using the mask pattern 31 as a mask, and thereafter, the mask was peeled (FIG. 11C).

(Step 6)

Figure 11D:
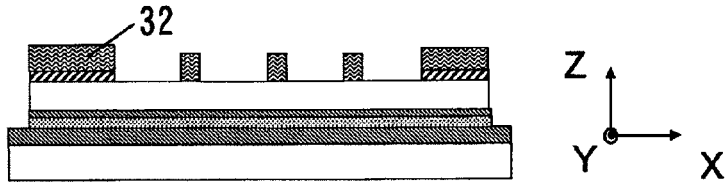

Next, a mask pattern 32 of resist was formed by using the photolithography method (FIG. 11D). This pattern has a rectangular opening with two sides Py2=3.5 μm and P3=5 μm. A plurality of the openings in which the opening pitch in the X direction P5=10 μm and the pitch in the Y direction Py1=2 μm are provided (FIG. 10A). However, the plural openings are positioned so as to be contained in the opening of the gate electrode.

(Step 7)

Figure 11E:
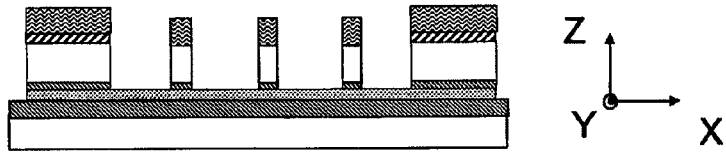

The insulating layer 3 and the first electrode 2*b* are then dry etched by using a $CF_4$ gas to peel the mask pattern, and, thus, to be sufficiently cleaned (FIG. 11E). The first electrode with the width Py1 was formed as the second electrode by this step. In this example, the opening of the first electrode and the opening of the gate electrode have the same shape. Namely, the opening of the first electrode of this example has a rectangular shape. The portion with the width Py1 of the mask pattern is positioned so as to be contained in the rectangular shape, and therefore, the second electrode is formed so as to divide the rectangular opening in the long side direction.

(Step 8)

Figure 11F:
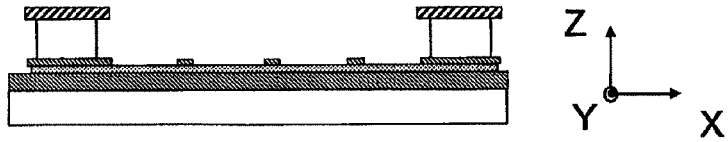

Next, wet etching was performed with buffered hydrofluoric acid as with the step 7 in the first example. $SiO_2$ of 1 μm was etched by controlling the etching time, whereby all the insulating layer 3 ($SiO_2$) on the second electrode was removed by etching performed from the both sides. Meanwhile, the other insulating layer 3 was partially etched. Thus, the opening of the insulating layer became larger in size than the opening of the gate electrode (FIG. 11F).

In this example, the second electrode is provided so as to divide the opening of the first electrode into plurals, and therefore, the length of the contour of the exposed region of the electron-emitting member can be increased. According to this constitution, a high emission current can be obtained without increasing the size of the electron-emitting device.

Third Example

A example of a manufacturing method of an electron-emitting device according to a third example is shown in FIGS. 12A to 12G. The plan view of the electron-emitting device as viewed from above a gate electrode is the same as FIG. 1A, and the laminating structure is different from the structure of FIG. 1B.

(Step 1)

Figure 12A:
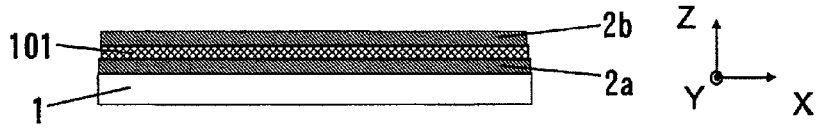
FIGS. 12A to 12G are views showing an example of a manufacturing method of an electron-emitting device according to a third example.

First, a soda-lime glass was used as the substrate 1. The substrate 1 was sufficiently cleaned, and thereafter, Ta with a thickness of 800 nm as the cathode electrode 2*a* was formed. SiN with a thickness of 150 nm as an insulating layer 101 was then formed on the substrate 1. Subsequently, Ta with a thickness of 50 nm as the first electrode 2*b* was formed on the insulating layer 101 (FIG. 12A).

(Step 2)

Figure 12B:
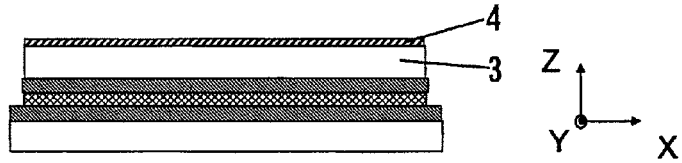

$SiO_2$ with a thickness of 1 μm as the insulating layer 3 was then deposited on the first electrode 2*b*, and Pt with a thickness of 200 nm as the gate electrode 4 was deposited on the first electrode 2*b* (FIG. 12B).

(Step 3)

Figure 12C:
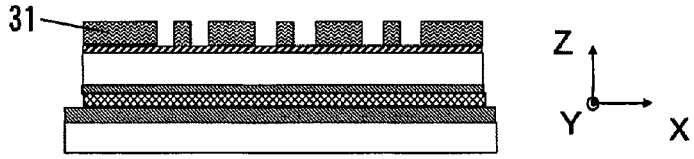

Next, the mask pattern 31 of resist was formed by using the photolithography method. The opening of the mask pattern 31 was the same as the opening in the first example (FIG. 12C).

(Step 4)

Figure 12D:
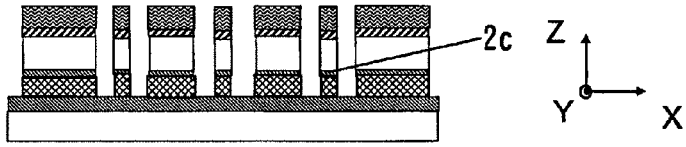

Next, the Pt gate electrode 4 was dry etched by Ar plasma etching using the mask pattern 31 as a mask, and the insulating layer 3, the first electrode 2*b*, and the insulating layer 101 were dry etched with a $CF_4$ gas using the mask pattern 31 as a mask (FIG. 12D). According to this step, the opening having the same shape as the opening in the first example and the second electrode were formed.

(Step 5)

Figure 12E:
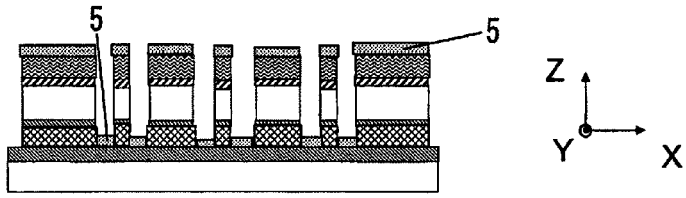

Next, diamond-like carbon with a thickness of about 50 nm as the electron-emitting member 5 was deposited on the entire surface of the device by the plasma CVD method. A $CH_4$ gas was used as a reaction gas (FIG. 12E).

(Step 6)

Figure 12F:
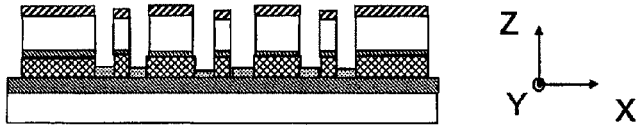

Subsequently, the mask pattern 31 was peeled to be sufficiently cleaned, whereby electron-emitting members other than the electron-emitting member 5 exposed in the opening were removed (FIG. 12F).

(Step 7)

Figure 12G:
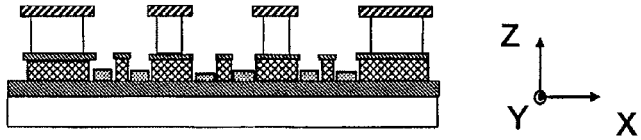

Next, wet etching was performed with buffered hydrofluoric acid. $SiO_2$ of 1 μm was etched by controlling the etching time. According to this step, $SiO_2$ with the width P1 of 2 μm (all the $SiO_2$ with the width P1) was etched from the both sides, and the gate electrode 4 on the $SiO_2$ was also removed. Meanwhile, the other insulating layer 3 was partially etched. According to this constitution, the opening of the insulating layer became larger in size than the opening of the gate electrode (FIG. 12G).

According to the above steps, the electron-emitting device with a laminating structure (FIG. 12G) different from FIG. 1B and showing the same plan view as FIG. 1A could be produced.

Fourth Example

Figure 13A:
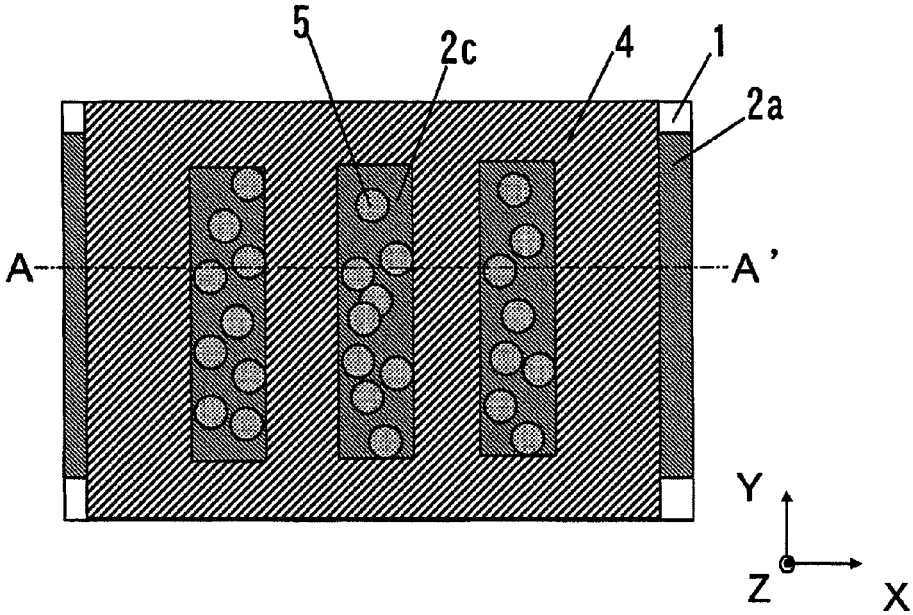
FIGS. 13A and 13B are schematic views of an electron-emitting device according to a fourth example.
Figure 13B:
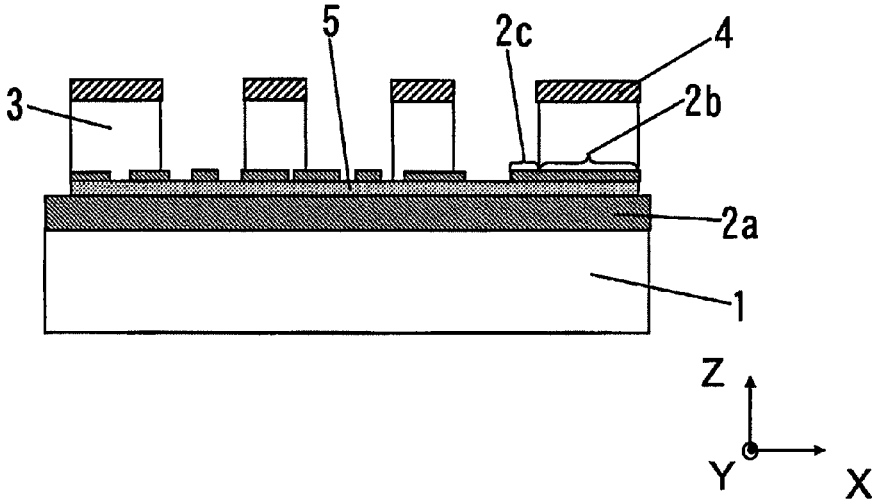

FIGS. 13A and 13B are schematic views of an electron-emitting device according to this example. FIG. 13A is a top plan view of the electron-emitting device. FIG. 13B is an A-A' cross-sectional view of FIG. 13A. In this example, a third cathode electrode has plural openings, and the plural openings are regions (exposed regions) to expose the electron-emitting member.

(Step 1)

First, a soda-lime glass was used as the substrate 1. The substrate 1 was sufficiently cleaned, and thereafter, Ta with a thickness of 800 nm as the cathode electrode 2*a* was formed on the substrate 1.

(Step 2)

Next, diamond-like carbon with a thickness of about 30 nm as the electron-emitting member 5 was deposited on the entire surface of the cathode electrode 2*a* by the plasma CVD method. A $CH_4$ gas was used as a reaction gas.

(Step 3)

Subsequently, circular masks were randomly formed on the electron-emitting member 5. Specifically, a spherical impermeable material was mixed in resist to form the circular masks by a photolithography process. Next, Ta with a thickness of 100 nm as the first electrode 2*b* was formed, and thereafter, the resist was removed. The opening diameter obtained by the removal of the resist was 1 μm. The mask may have different shapes than circular such as a polygonal shape or others, and, in addition, the size and the position may not be random. The mask may have a random shape.

(Step 4)

Next, $SiO_2$ with a thickness of 1 μm as the insulating layer 3 was deposited on the first electrode. The opening of the first electrode was filled with the insulating layer 3 (in this example, the opening temporarily formed of resist is not called the opening of the first electrode). Pt with a thickness of 200 nm as the gate electrode 4 was then deposited on the insulating layer 3.

(Step 5)

Next, the mask pattern 31 of resist was formed by using the photolithography method. Plural openings with a width of 3.5 μm were formed at a pitch of 7 μm.

(Step 6)

Subsequently, the Pt gate electrode 4 was dry etched by Ar plasma etching using the mask pattern 31 as a mask, and the insulating layer 3 was dry etched with a $CF_4$ gas using the mask pattern 31 as a mask. Incidentally, it is assumed that the opening of the first electrode and the opening of the gate electrode have the same shape. Namely, in this example, the first electrode located in the opening is considered as the second electrode 2*c* having plural random openings.

(Step 7)

Next, the mask pattern 31 was peeled to be sufficiently cleaned.

According to the above steps, the device of FIGS. 13A and 13B could be produced.

In this example, a large number of openings smaller than the opening of the gate electrode were formed in the opening of the gate electrode, whereby the emission area can be rendered much larger than the case in which large openings are provided, and therefore, a high emission current can be obtained.

Fifth Example

The electron-emitting devices according to the first example were aligned as follows: 1280 pieces of the electron-emitting devices in the X direction; and 720 pieces of the electron-emitting devices in the Y direction, whereby the electron source shown in FIG. 6 was produced. Further, the display panel of the image display apparatus shown in FIG. 7 was produced. The display panel was displayed by the drive circuit shown in FIG. 8.

The image display apparatus in this example realizes high gradation at a low brightness in an affordable circuit with a small capacity.

As described above, the electron-emitting device according to this embodiment can provide a large current emission without increasing the size of the electron-emitting device. Further, the electron-emitting device can be produced without including complex steps.

In addition, this electron-emitting device is applied to an electron source and an image display apparatus, whereby a high-performance electron source and a high definition and high quality image display apparatus can be realized.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-313702, filed on Dec. 4, 2007, which is hereby incorporated by reference herein in its entirety.

What is claimed is:

1. An electron-emitting device comprising a cathode electrode, a first electrode, a second electrode, an insulating layer, a gate electrode, and an electron-emitting member, wherein the gate electrode is located above the cathode electrode, the insulating layer is located between the gate electrode and the cathode electrode, the first electrode is located between the cathode electrode and the insulating layer and is electrically connected to the cathode electrode, the gate electrode, the insulating layer, and the first electrode respectively have an opening communicating with each other, and the electron-emitting member is provided on the cathode electrode, and at least one portion of the electron-emitting member is exposed in the opening, and the second electrode is located on the electron-emitting member and is electrically connected to the cathode electrode through the electron-emitting member, and is provided in the opening of the first electrode so that not only a region corresponding to a periphery of a contour of the opening of the gate electrode but also a periphery of a contour of the second electrode becomes an emission region.

2. An electron-emitting device according to claim 1, wherein the second electrode is provided in an island shape in the opening of the first electrode.

3. An electron-emitting device according to claim 1, wherein the second electrode is separated from the first electrode.

4. An electron-emitting device according to claim 1, wherein the second electrode is provided so as to divide the opening of the first electrode into plural segments.

5. An electron-emitting device according to claim 4, wherein the opening of the first electrode has a rectangular shape, and the second electrode is provided so as to divide the rectangular shape.

6. An electron-emitting device according to claim 1, wherein the second electrode has a plurality of openings, and the plurality of openings are regions to expose the electron-emitting member.

7. A manufacturing method of an electron-emitting device comprising the steps of forming a cathode electrode, forming a first electrode, providing a second electrode, forming an insulating layer, forming a gate electrode, and forming an electron-emitting member, wherein the gate electrode is located above the cathode electrode, the insulating layer is located between the gate electrode and the cathode electrode, the first electrode is located between the cathode electrode and the insulating layer and is electrically connected to the cathode electrode, the gate electrode, the insulating layer, and the first electrode respectively have an opening communicating with each other, and the electron-emitting member is provided on the cathode electrode, and at least one portion of the electron-emitting member is exposed in the opening, and the second electrode is located on the electron-emitting member and is electrically connected to the cathode electrode through the electron-emitting member, and is provided in the opening of the first electrode so that not only a region corresponding to a periphery of a contour of the opening of the gate electrode but also a periphery of a contour of the second electrode becomes an emission region.

8. A manufacturing method of an electron-emitting device according to claim 7, wherein the step of providing the second electrode includes a step of remaining a part of the first electrode as the second electrode in the opening of the first electrode at the time when the opening is formed in the first electrode.

9. An electron source comprising a plurality of the electron-emitting devices according to claim 1.

10. An image display apparatus comprising the electron source according to claim 9 and an image forming member which forms an image by electrons emitted from the electron source.

11. An electron-emitting device comprising: a cathode electrode, a first electrode, a second electrode, an insulating layer, a gate electrode, and an electron-emitting member, wherein the electron-emitting member, the first electrode, the insulating layer and the gate electrode are formed in this order on the cathode electrode, and the gate electrode, the insulating layer, and the first electrode have an opening through which the electron-emitting member is exposed, and the second electrode is formed on the electron-emitting member in the opening so that not only a region corresponding to a periphery of a contour of the opening of the gate electrode but also a periphery of a contour of the second electrode becomes an emission region.

12. An image display apparatus comprising:

an electron source having a plurality of the electron-emitting devices according to claim 11; and an image forming member which forms an image by electrons emitted from the electron source.

* * * * *